US011531291B2

(12) United States Patent
Sakaguchi et al.

(10) Patent No.: US 11,531,291 B2
(45) Date of Patent: Dec. 20, 2022

(54) IMAGE FORMING APPARATUS

(71) Applicant: CANON KABUSHIKI KAISHA, Tokyo (JP)

(72) Inventors: Ryou Sakaguchi, Ibaraki (JP); Yuya Ohta, Chiba (JP); Akinobu Nishikata, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/494,363

(22) Filed: Oct. 5, 2021

(65) Prior Publication Data

US 2022/0026833 A1 Jan. 27, 2022

Related U.S. Application Data

(62) Division of application No. 17/178,533, filed on Feb. 18, 2021, now Pat. No. 11,175,612.

(30) Foreign Application Priority Data

Feb. 26, 2020 (JP) ..... JP2020-031082

(51) Int. Cl.
*G03G 15/16* (2006.01)
*G03G 15/00* (2006.01)

(52) U.S. Cl.
CPC ..... *G03G 15/1675* (2013.01); *G03G 15/1685* (2013.01); *G03G 15/6558* (2013.01); *G03G 2215/00742* (2013.01)

(58) Field of Classification Search
CPC ..... G03G 15/1605; G03G 21/1633; G03G 15/1615; G03G 15/1685; G03G 15/1675; G03G 15/655
See application file for complete search history.

(56) References Cited

U.S. PATENT DOCUMENTS

| | | | | |
|---|---|---|---|---|
| 8,406,658 | B2 | 3/2013 | Kaseda | |
| 9,304,472 | B2 | 4/2016 | Ishikawa | |
| 2007/0217801 | A1 | 9/2007 | Tsuboi et al. | |
| 2012/0155897 | A1* | 6/2012 | Torimaru | G03G 15/167 399/45 |
| 2014/0140727 | A1 | 5/2014 | Shimoi | |
| 2014/0334847 | A1 | 11/2014 | Takahashi et al. | |

(Continued)

FOREIGN PATENT DOCUMENTS

| | | | |
|---|---|---|---|
| JP | 2011-064917 | A | 3/2011 |
| JP | 2014-134718 | A | 7/2014 |
| JP | 2016-031471 | A | 3/2016 |

*Primary Examiner* — Jessica L Eley
(74) *Attorney, Agent, or Firm* — Venable LLP

(57) ABSTRACT

An image forming apparatus includes an image forming portion, a rotatable intermediary transfer belt, a plurality of stretching rollers, an outer roller, a moving mechanism, and a controller. In a case that a basis weight of a first recording material is a first basis weight and a basis weight of a second recording material is a second basis weight greater than the first basis weight, a position of the inner roller is a second position when the toner image is transferred onto the second recording material, and in a case that the basis weight of the first recording material and the basis weight of the second recording material are the second basis weight, the position of the inner roller is a first position when the toner image is transferred onto the second recording material.

8 Claims, 15 Drawing Sheets

(56) References Cited

U.S. PATENT DOCUMENTS

| | | | | |
|---|---|---|---|---|
| 2015/0220050 | A1* | 8/2015 | Fukase | G03G 21/1647 399/110 |
| 2018/0112762 | A1* | 4/2018 | Nieda | G03G 21/1685 |

* cited by examiner (a) NORMAL MODE (b) PRODUCTIVITY PRIORITY MODE (a)

(b)

(a)

(b)

IMAGE FORMING APPARATUS

FIELD OF THE INVENTION AND RELATED ART

The present invention relates to an image forming apparatus, such as a copying machine, a printer or a facsimile machine, using an electrophotographic type or an electrostatic recording type.

Conventionally, as the image forming apparatus using the electrophotographic type, there is an image forming apparatus using an endless belt as an image bearing member for bearing a toner image. As such a belt, for example, there is an intermediary transfer belt used as a second image bearing member for feeding a sheet-like recording material such as paper from a photosensitive member or the like as a first image bearing member. In the following principally, an image forming apparatus employing an intermediary transfer type including an intermediary transfer belt will be described as an example.

In the image forming apparatus of the intermediary transfer type, a toner image formed on the photosensitive member or the like is primary-transferred onto the intermediary transfer belt at a primary transfer portion. Then, the toner image primary-transferred on the intermediary transfer belt is secondary-transferred onto the recording material at a secondary transfer portion. By an inner member (inner secondary transfer member) provided on an inner peripheral surface side and an outer member (outer secondary transfer member) provided on an outer peripheral surface side, a secondary transfer nip as the secondary transfer portion which is a contact portion between the intermediary transfer belt and the outer member is formed. As the inner member, an inner roller which is one of a plurality of stretching rollers for stretching the intermediary transfer belt is used. As the outer member, an outer roller which is provided in a position opposing the inner roller while nipping the intermediary transfer belt between itself and the inner roller and which is pressed toward the inner roller is used in many instances. Further, for example, a secondary transfer voltage of a polarity opposite to a charge polarity of toner is applied to the outer roller, so that the toner image is secondary-transferred from the intermediary transfer belt onto the recording material in the secondary transfer nip. In general, with respect to a feeding direction of the recording material, on a side upstream of the secondary transfer nip, a feeding guide for guiding the recording material to the secondary transfer nip is provided.

Here, depending on a shape of the secondary transfer nip, behavior of the recording material changes in the neighborhoods of the secondary transfer nip on sides upstream and downstream of the secondary transfer nip with respect to the recording material feeding direction. Further, depending on rigidity of the recording material, the behavior of the recording material also changes in the neighborhoods of the secondary transfer nip on the sides upstream and downstream of the secondary transfer nip with respect to the recording material feeding direction. For example, in the case where the recording material is "thin paper" which is an example of the recording material with small rigidity, in the neighborhood of the secondary transfer nip on the side downstream of the secondary transfer nip with respect to the recording material feeding direction, the intermediary transfer belt and the recording material stick to each other, so that a jam (paper jam) occurs in some instances due to improper separation of the recording material from the intermediary transfer belt.

On the other hand, in the case where the recording material is "thick paper" which is an example of the recording material with large rigidity, when a trailing end of the recording material with respect to the recording material feeding direction passes through the feeding guide, a tailing end portion of the recording material with respect to the recording material feeding direction collides with the intermediary transfer belt in some instances. Then, with respect to the recording material feeding direction, an attitude of the intermediary transfer belt in the neighborhood of the secondary transfer nip on the upstream side is disturbed, so that an image defect (a stripe-shaped image disturbance or the like extending in a direction substantially perpendicular to the recording material feeding direction) occurs in some instances.

In order to solve such problems, a constitution in which a shape (position) of the secondary transfer nip is changed depending on a kind of the recording material has been proposed (Japanese Laid-Open Patent Application 2014-134718).

As described above, in order to realize improvement in separating property of the recording material from the intermediary transfer belt and suppression of the image defect at the trailing end portion of the recording material with respect to the recording material feeding direction, it is effective that the shape (position) of the secondary transfer nip is changed depending on the kind of the recording material. This change in shape (position) of the secondary transfer nip can be made by changing a relative position between the inner roller and the outer roller with respect to a circumferential direction of the inner roller through movement of the inner roller or the outer roller in a direction crossing a pressing direction in the secondary transfer nip. For example, it would be considered that the relative position is determined on the basis of whether or not a basis weight of the recording material as information on a kind of the recording material relating to rigidity of the recording material is a predetermined threshold or more.

Here, in the image forming apparatus of an electrophotographic type or the like, for example, in order to perform bookbinding printing, a continuous image forming job for forming images on a plurality of kinds of recording materials P (this job is also referred to as a "mixed job" in this embodiment) is executed in some instances. In this case, in a constitution in which the above-described relative position is changed as described above, in the case where the mixed job using the plurality of kinds of recording materials different in basis weight, such as "thin paper" and "thick paper" is executed, the relative position is frequently changed with every change in kind of the recording material in some instances.

When an operation for changing the above-described relative position is performed, image formation cannot be carried out. Further, in order to suppress damage (scars) on the intermediary transfer belt, the operation for changing the relative position may desirably be performed after stopping application of all the image forming high-voltages such as a charging voltage, a developing voltage, a primary transfer voltage and a secondary transfer voltage and stopping rotation of the intermediary transfer belt. In this case, after the change in relative position is made, the rotation of the intermediary transfer belt is resumed and the image forming high-voltages are applied again, and then an image forming operation is carried out. For that reason, the change is excessively made frequently, and it takes a long time to change the relative position, so that there is a liability that productivity lowers.

In the above, conventional problems were described taking, as an example, the secondary transfer portion which is a transfer portion of the toner image from the intermediary transfer belt onto the recording material, but there are similar problems also as to another transfer portion of the toner image from another belt-shaped image bearing member such as a photosensitive belt onto the recording material.

SUMMARY OF THE INVENTION

A principal object of the present invention is to provide an image forming apparatus capable of suppressing a lowering in productivity while improving a transfer property of an image onto a recording material in a mixed job.

The object has been accomplished by the image forming apparatus according to the present invention.

According to an aspect of the present invention, there is provided an image forming apparatus comprising: an image forming portion configured to form a toner image; a rotatable intermediary transfer belt onto which the toner image formed by the image forming portion is transferred; a plurality of stretching rollers stretching the intermediary transfer belt and including an inner roller and an upstream roller provided adjacent to the inner roller on a side upstream of the inner roller with respect to a rotational direction of the intermediary transfer belt; an outer roller contacting an outer peripheral surface of the intermediary transfer belt and configured to form a transfer nip, where the toner image is transferred from the intermediary transfer belt onto a recording material, by nipping the intermediary transfer belt between itself and the inner roller; a moving mechanism capable of moving a position of the inner roller between a first position where an offset amount X is a first offset amount X1 and a second position where the offset amount X is a second offset amount X2 which is larger than the first offset amount X1, wherein in a cross section perpendicular to a rotational axis direction of the inner roller, an external common tangential line between the inner roller and the upstream roller on a side where the intermediary transfer belt is stretched by these rollers is a reference line L1, a rectilinear line passing through a rotation center of the inner roller and perpendicular to the reference line L1 is an inner roller center line L2, a rectilinear line passing through a rotation center of the outer roller and perpendicular to the reference line L1 is an outer roller center line L3, and a distance between the inner roller center line L2 and the outer roller center line L3 is the offset amount X which is a positive value when the outer roller center line L3 is positioned upstream of the inner roller central line L2 with respect to the rotational direction of the intermediary transfer belt; and a controller configured to control the moving mechanism, wherein when a continuous image forming job for transferring toner images onto a plurality of recording materials including a first recording material and a second recording material subsequent to the first recording material is executed, in a case that the first recording material having a first basis weight is to receive the toner image with the inner roller at the second position and the second recording material having a second basis weight larger than the first basis weight is then to receive the toner image, the position of the inner roller remains in the second position when the toner image is transferred onto the second recording material, and in a case that the first recording material having the second basis weight is to receive the toner image with the inner roller at the first position and the second recording material having the second basis weight is then to receive the toner image, the position of the inner roller remains in the first position when the toner image is transferred onto the second recording material.

According to another aspect of the present invention, there is provided an image forming apparatus comprising: an image forming portion configured to form a toner image; a rotatable intermediary transfer belt onto which the toner image formed by the image forming portion is transferred; a plurality of stretching rollers stretching the intermediary transfer belt and including an inner roller and an upstream roller provided adjacent to the inner roller on a side upstream of the inner roller with respect to a rotational direction of the intermediary transfer belt; an outer roller contacting an outer peripheral surface of the intermediary transfer belt and configured to form a transfer nip, where the toner image is transferred from the intermediary transfer belt onto a recording material, by nipping the intermediary transfer belt between itself and the inner roller; a moving mechanism capable of moving a position of the inner roller between a first position where an offset amount X is a first offset amount X1 and a second position where the offset amount X is a second offset amount X2 which is larger than the first offset amount X1, wherein in a cross section perpendicular to a rotational axis direction of the inner roller, an external common tangential line between the inner roller and the upstream roller on a side where the intermediary transfer belt is stretched by these rollers is a reference line L1, a rectilinear line passing through a rotation center of the inner roller and perpendicular to the reference line L1 is an inner roller center line L2, a rectilinear line passing through a rotation center of the outer roller and perpendicular to the reference line L1 is an outer roller center line L3, and a distance between the inner roller center line L2 and the outer roller center line L3 is the offset amount X which is a positive value when the outer roller center line L3 is positioned upstream of the inner roller central line L2 with respect to the rotational direction of the intermediary transfer belt; and a controller configured to control the moving mechanism, wherein when a continuous image forming job for transferring toner images onto a plurality of recording materials including a first recording material and a second recording material subsequent to the first recording material is executed, in a case that the first recording material having a first basis weight is to receive the toner image with the inner roller at the first position and the second recording material having a second basis weight smaller than the first basis weight is then to receive the toner image, the position of the inner roller remains in the first position when the toner image is transferred onto the second recording material, and in a case that the first recording material having the second basis weight is to receive the toner image with the inner roller at the second position and the second recording material having the second basis weight is then to receive the toner image, the position of the inner roller remains in the second position when the toner image is transferred onto the second recording material.

According to a further aspect of the present invention, there is provided an image forming apparatus comprising: an image forming portion configured to form a toner image; a rotatable intermediary transfer belt onto which the toner image formed by the image forming portion is transferred; a plurality of stretching rollers stretching the intermediary transfer belt and including an inner roller and an upstream roller provided adjacent to the inner roller on a side upstream of the inner roller with respect to a rotational direction of the intermediary transfer belt; an outer roller contacting an outer peripheral surface of the intermediary transfer belt and configured to form a transfer nip, where the toner image is transferred from the intermediary transfer belt onto a recording material, by nipping the intermediary transfer belt between itself and the inner roller; a moving mechanism capable of moving a position of the inner roller between a first position where an offset amount X is a first offset amount X1 and a second position where the offset amount X is a second offset amount X2 which is larger than the first offset amount X1, wherein in a cross section perpendicular to a rotational axis direction of the inner roller, an external common tangential line between the inner roller and the upstream roller on a side where the intermediary transfer belt is stretched by these rollers is a reference line L1, a rectilinear line passing through a rotation center of the inner roller and perpendicular to the reference line L1 is an inner roller center line L2, a rectilinear line passing through a rotation center of the outer roller and perpendicular to the reference line L1 is an outer roller center line L3, and a distance between the inner roller center line L2 and the outer roller center line L3 is the offset amount X which is a positive value when the outer roller center line L3 is positioned upstream of the inner roller central line L2 with respect to the rotational direction of the intermediary transfer belt; and a controller configured to control the moving mechanism, wherein when a continuous image forming job for transferring toner images onto a plurality of recording materials including a first recording material and a second recording material subsequent to the first recording material is executed, in a case that the first recording material having a first basis weight is to receive the toner image with the inner roller at the second position and the second recording material having a second basis weight larger than the first basis weight is then to receive the toner image, the position of the inner roller remains in the second position when the toner images are transferred onto the first recording material and the second recording material, and in a case that the first recording material having a third basis weight larger than the second basis weight is to receive the toner image with the inner roller at the first position and the second recording material having the second basis weight is then to receive the toner image, the position of the inner roller remains in the first position when the toner images are transferred onto the first recording material and the second recording material.

Further features of the present invention will become apparent from the following description of exemplary embodiments with reference to the attached drawings.

Figure 3:
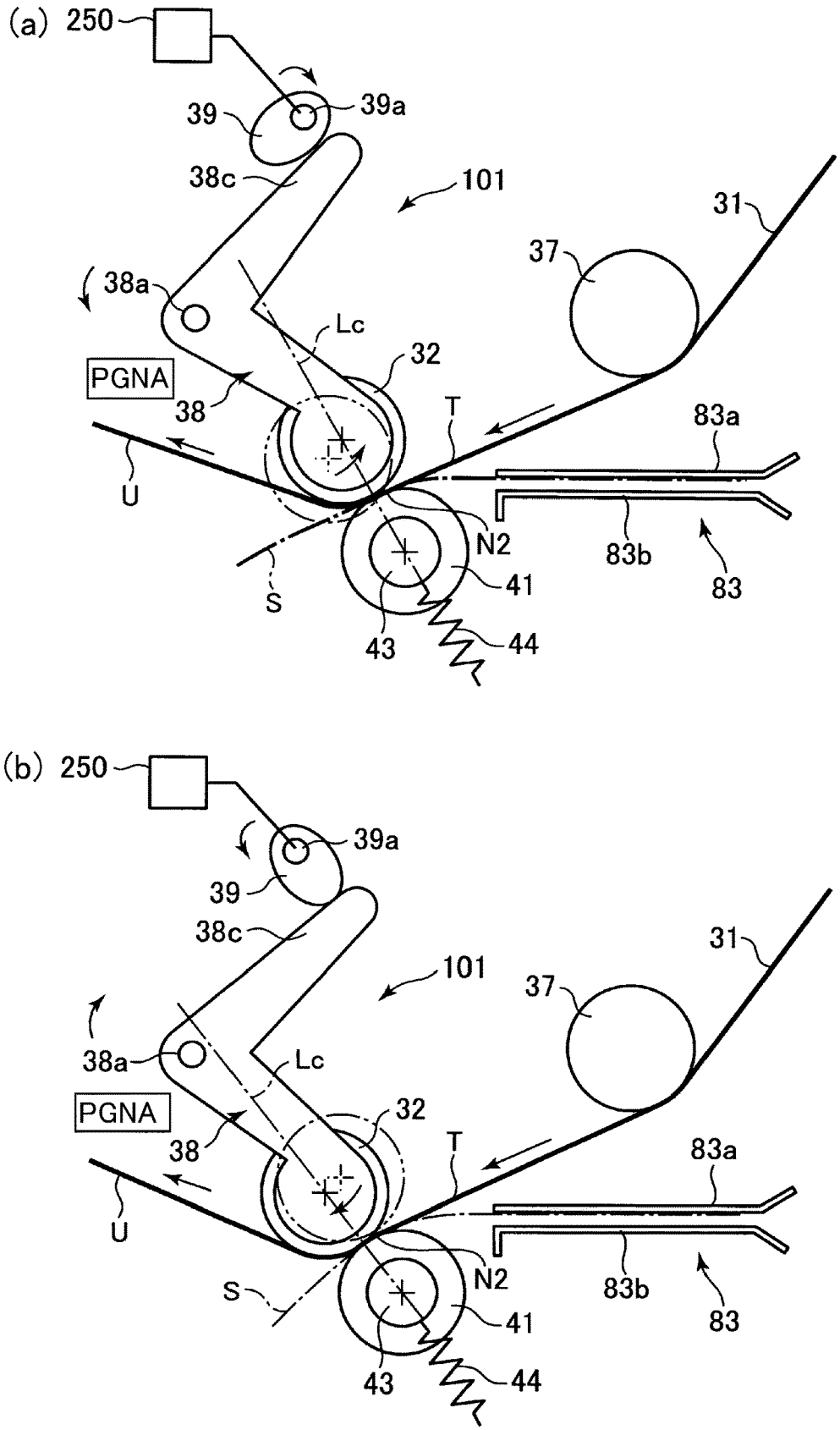

Parts (a) and (b) of FIG. 3 are schematic side views each showing an offset mechanism.

Figure 4:
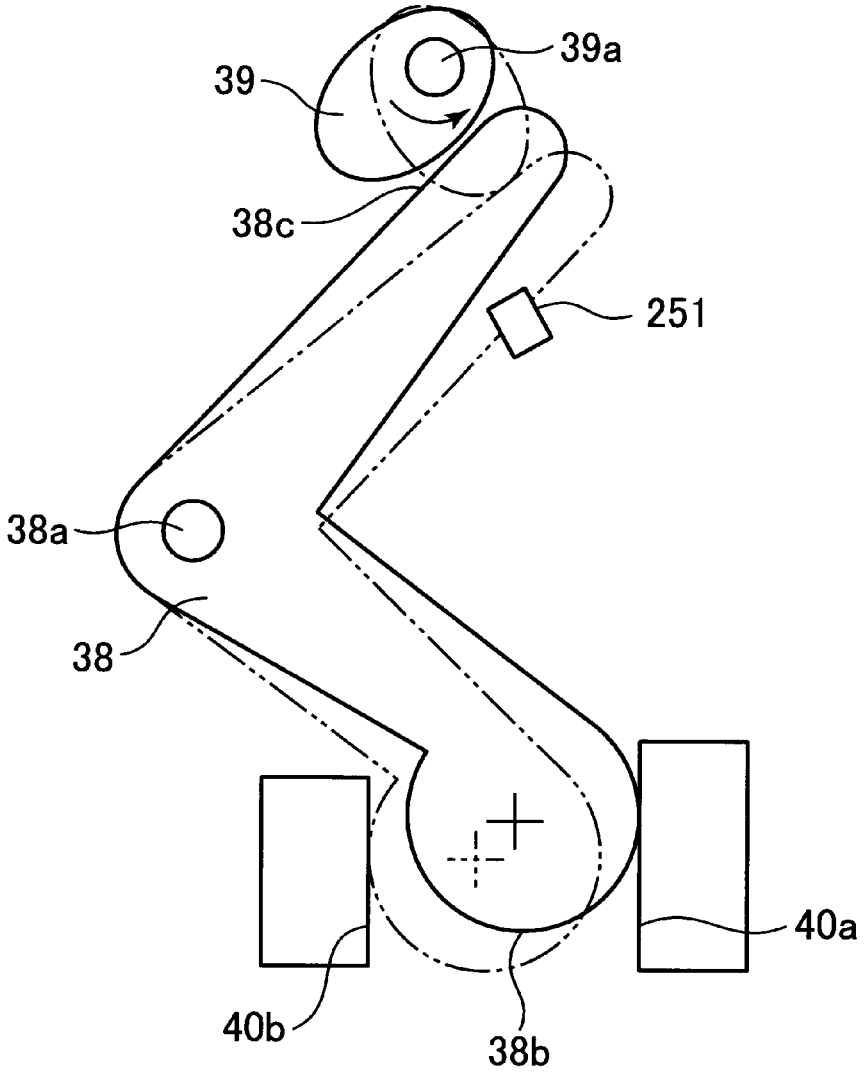

FIG. 4 is a schematic side view showing a part of the offset mechanism.

Figure 5:
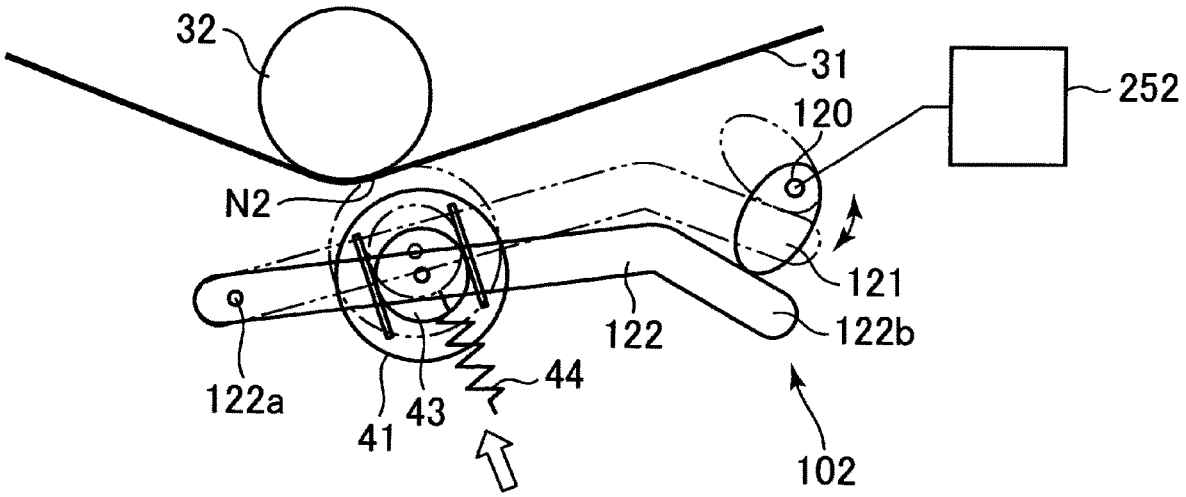

FIG. 5 is a schematic sectional view showing a contact-and-separation mechanism.

Figure 6:
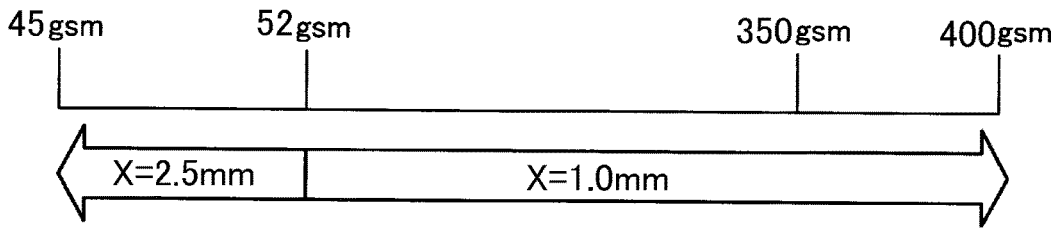
Figure 6:
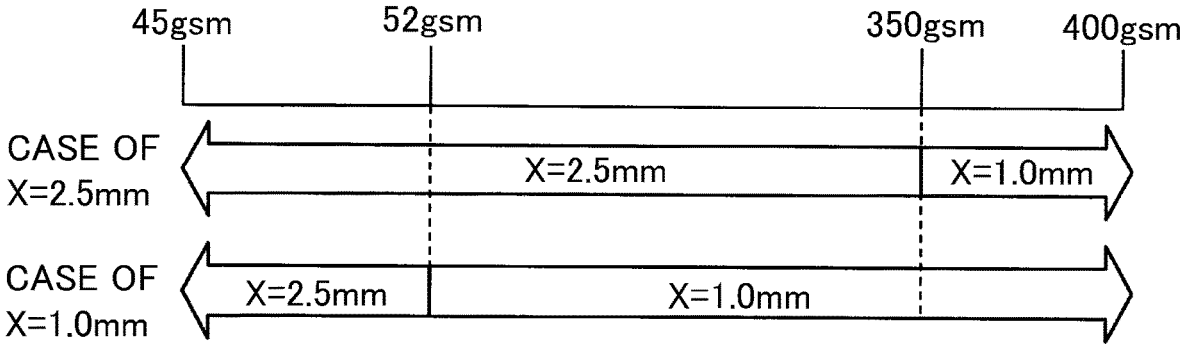

Parts (a) and (b) of FIG. 6 are schematic views each showing a change condition of an offset amount in an embodiment 1.

Figure 7:
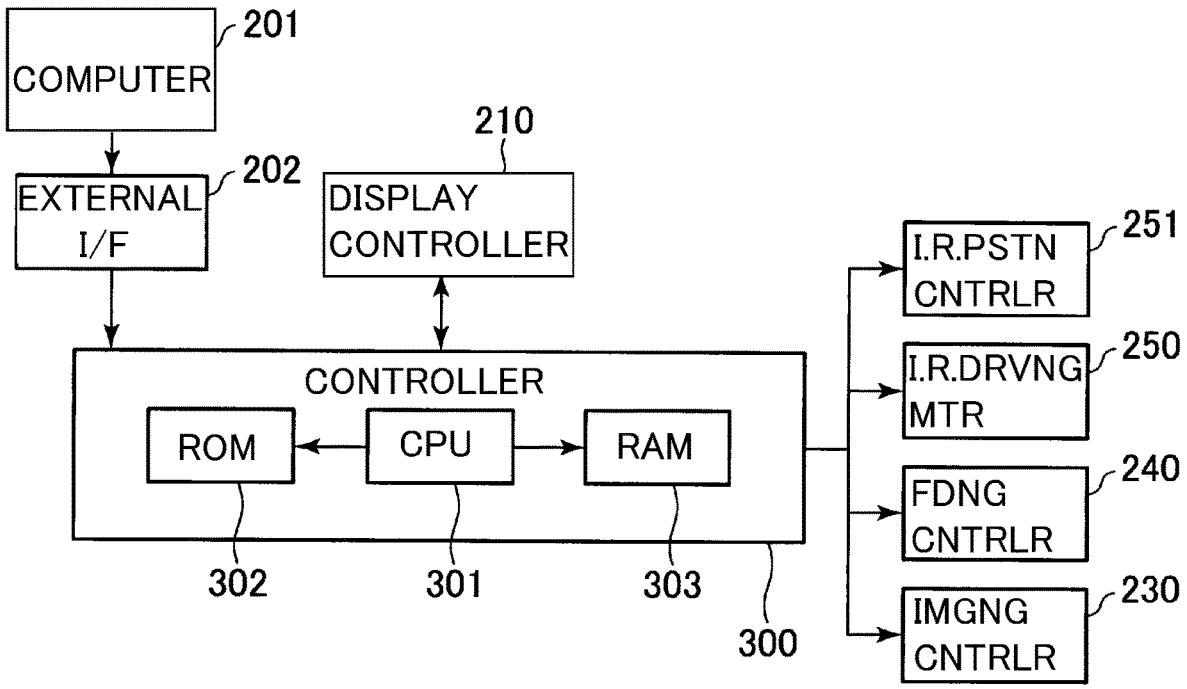

FIG. 7 is a schematic block diagram showing a control mode of a principal part of an image forming apparatus.

Figure 8:
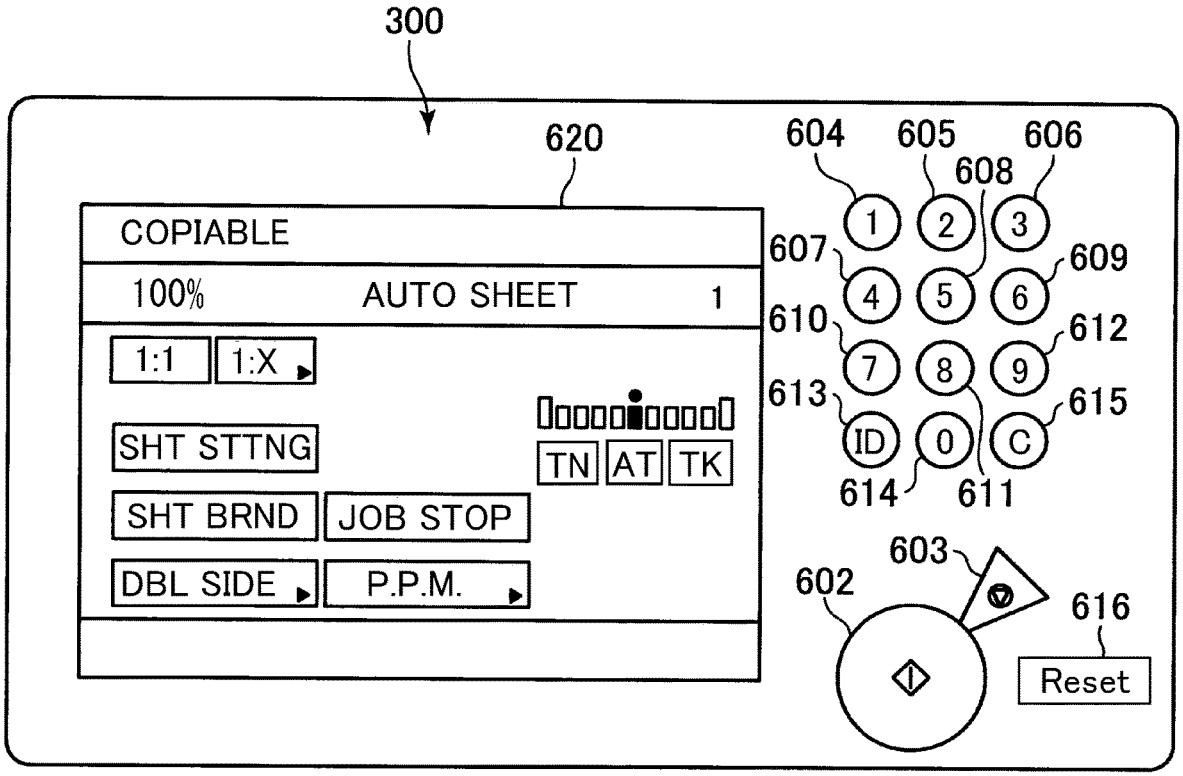
Figure 8:
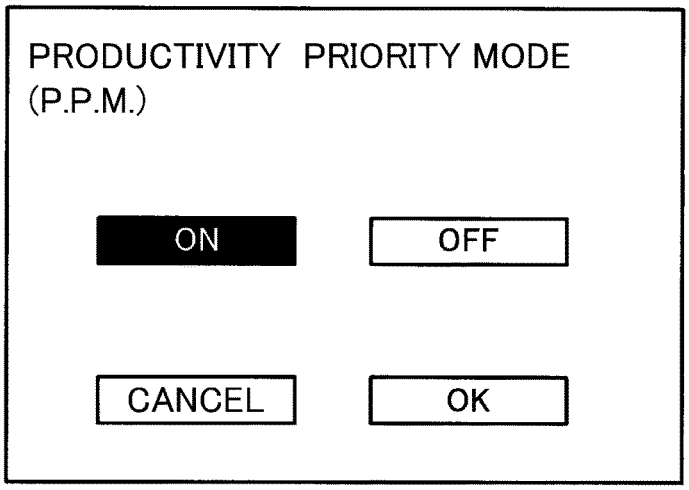

Parts (a) and (b) of FIG. 8 are schematic views for illustrating a setting screen of a productivity priority mode.

Figure 9:
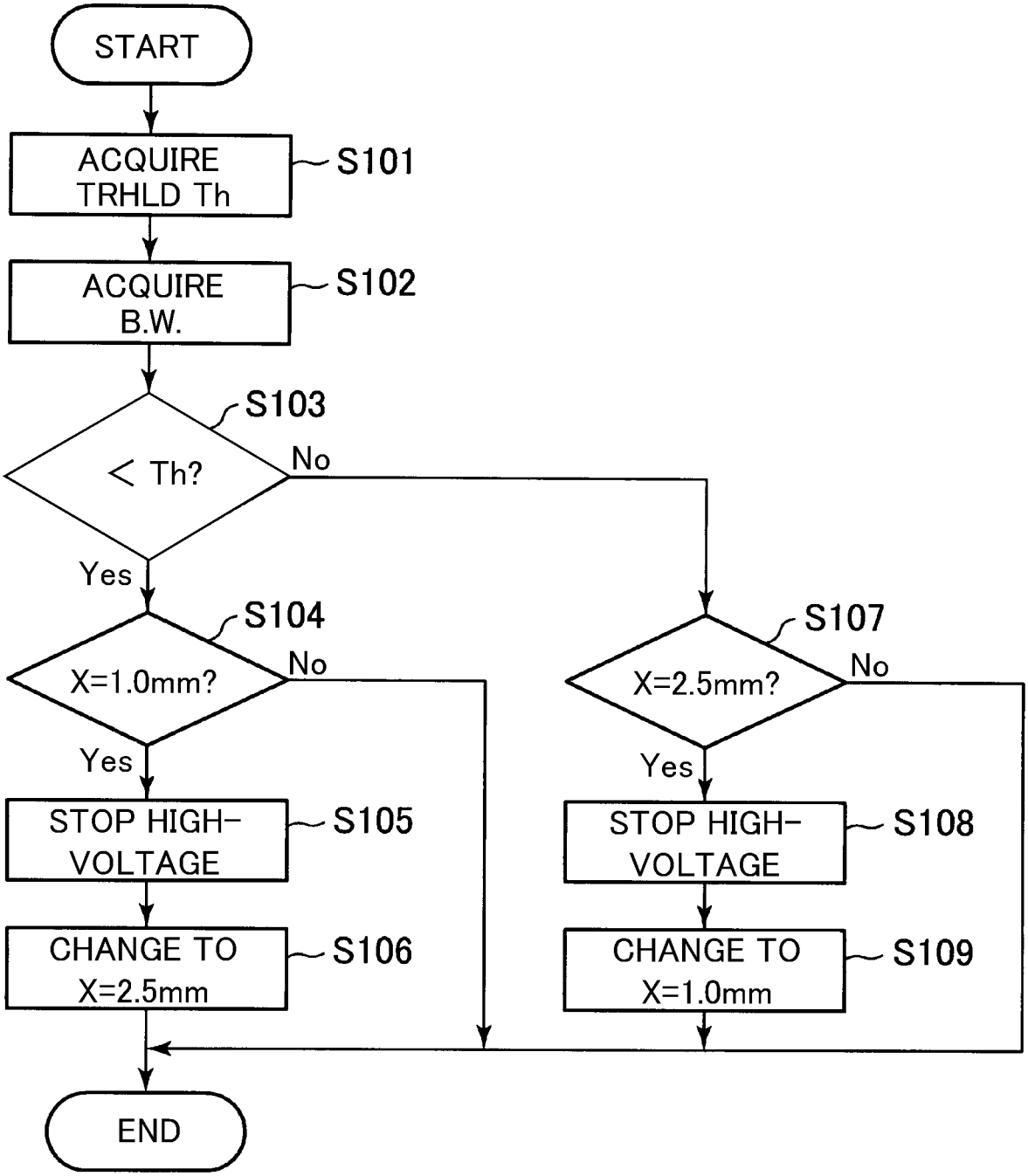

FIG. 9 is a flowchart of a changing of the offset amount.

Figure 10:
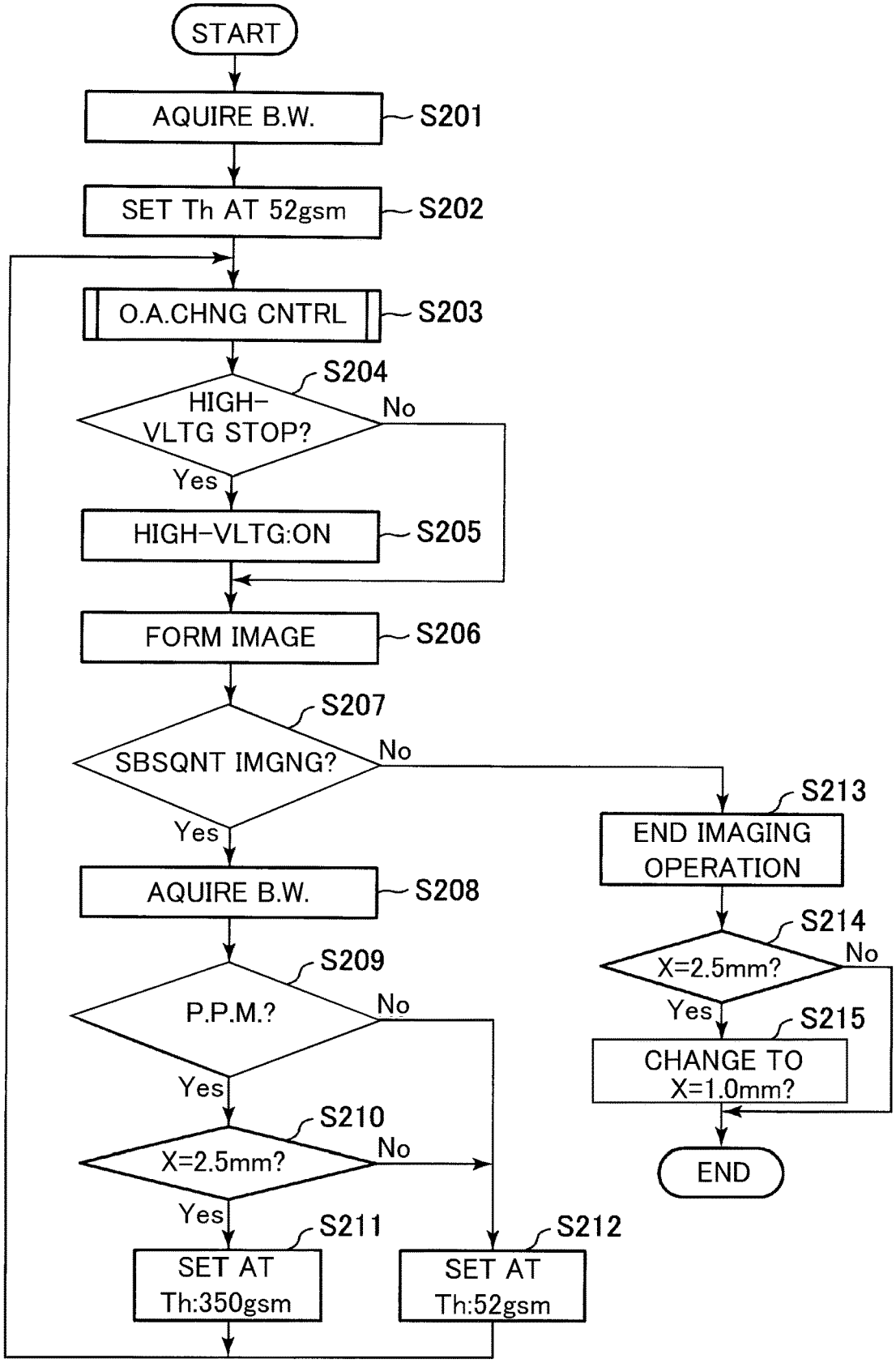

FIG. 10 is a flowchart of an operation of a job in the embodiment 1.

Figure 11:
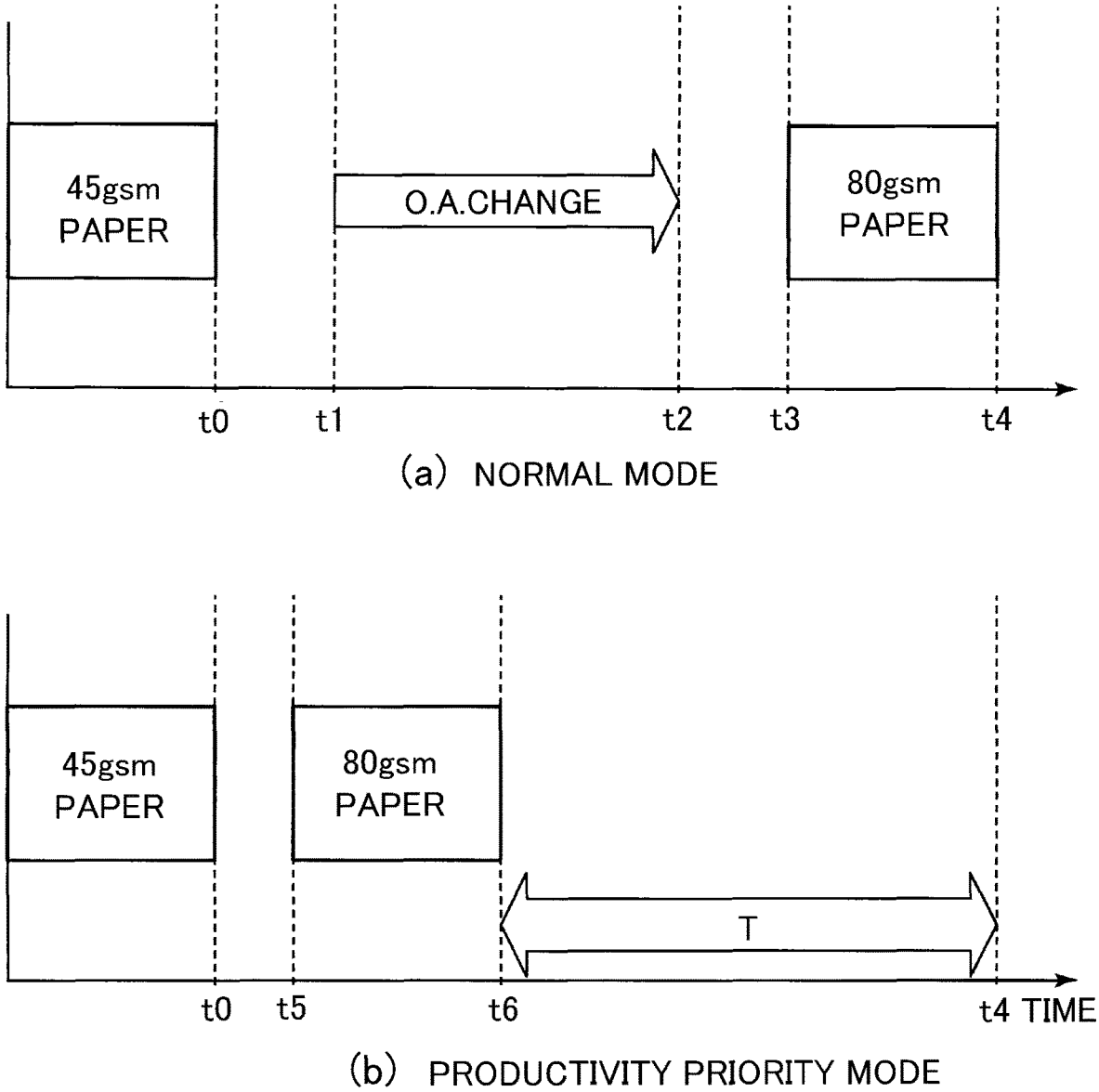

Parts (a) and (b) of FIG. 11 are time charts for illustrating an effect of control in the embodiment 1.

Figure 12:
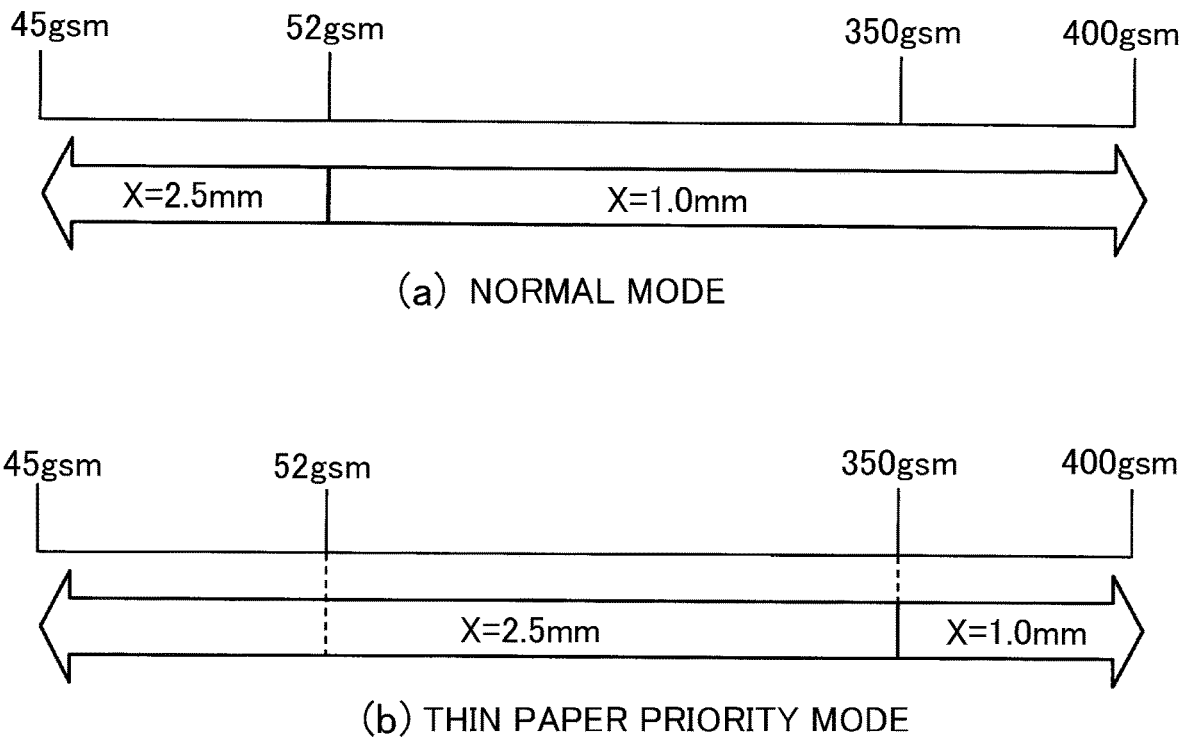

Parts (a) and (b) of FIG. 12 are schematic views each showing a change condition of an offset amount in an embodiment 2.

Figure 13:
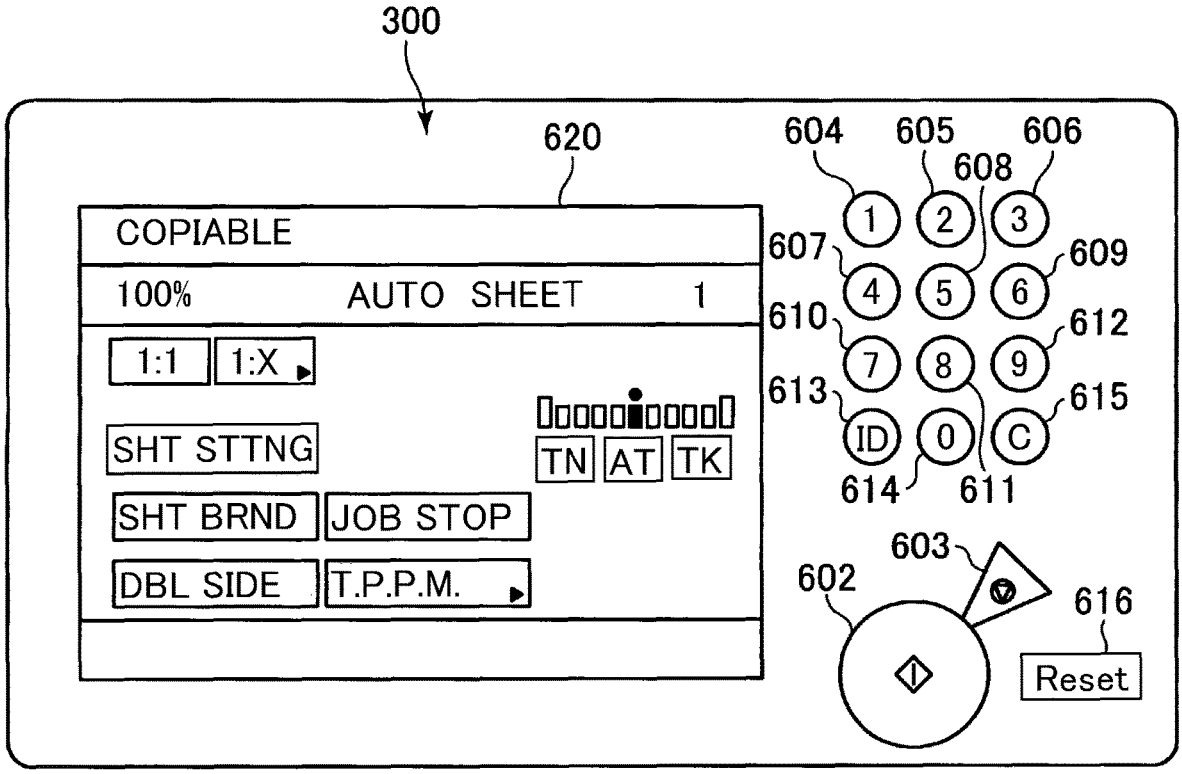
Figure 13:
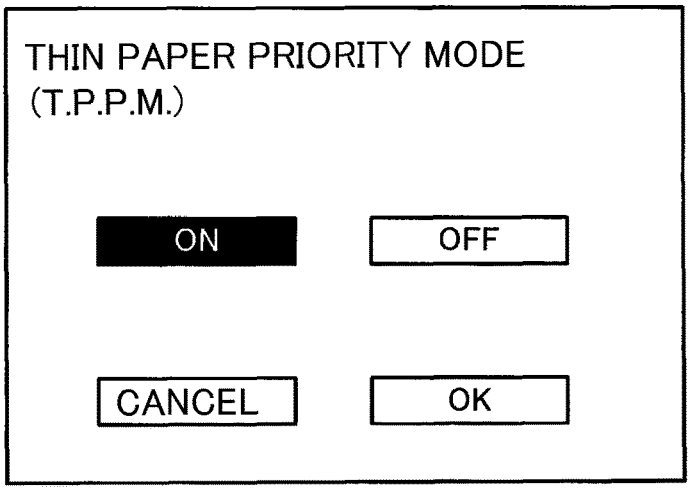

Parts (a) and (b) of FIG. 13 are schematic views for illustrating a setting screen of a thin paper priority mode in the embodiment 2.

Figure 14:
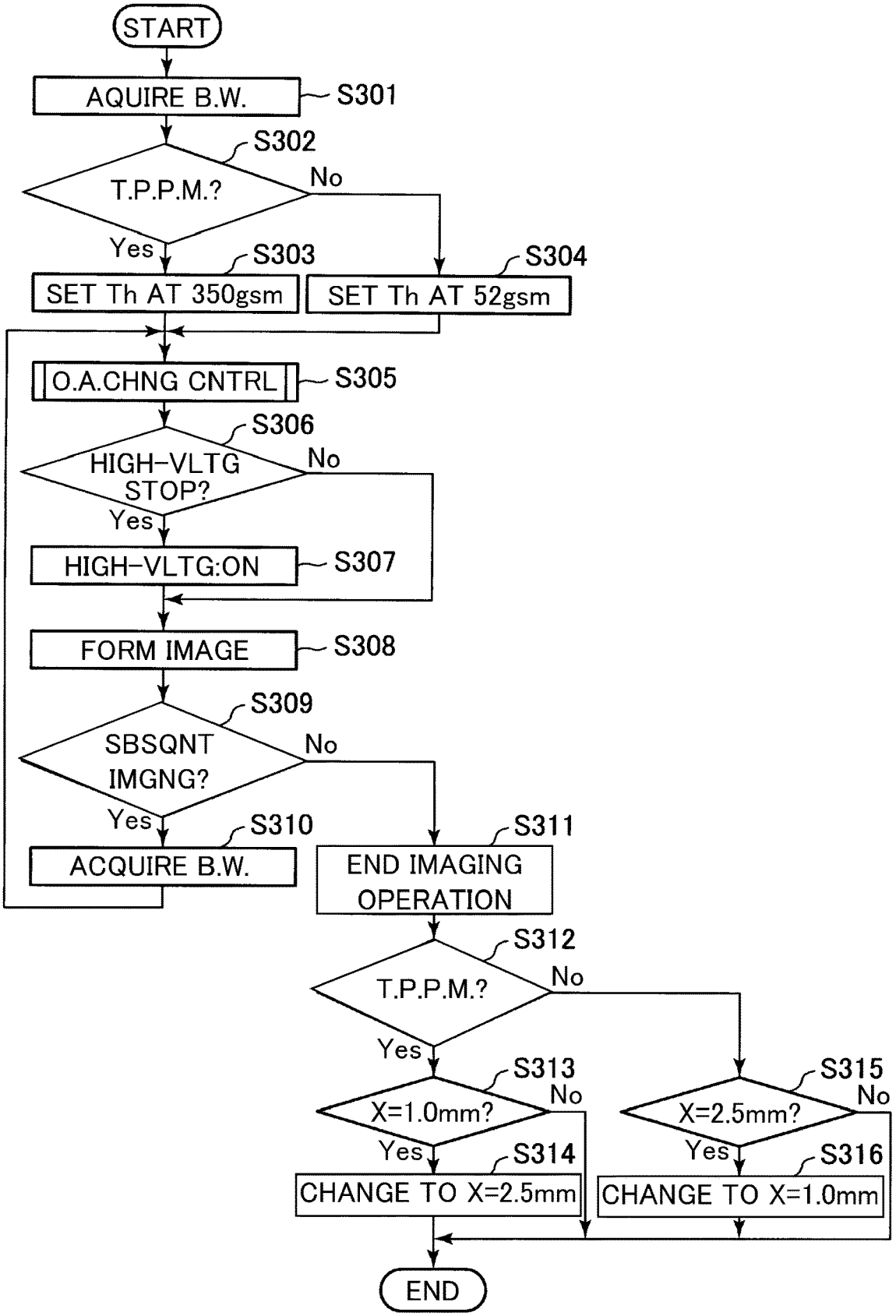

FIG. 14 is a flowchart of an operation of a job in the embodiment 2.

Figure 15:
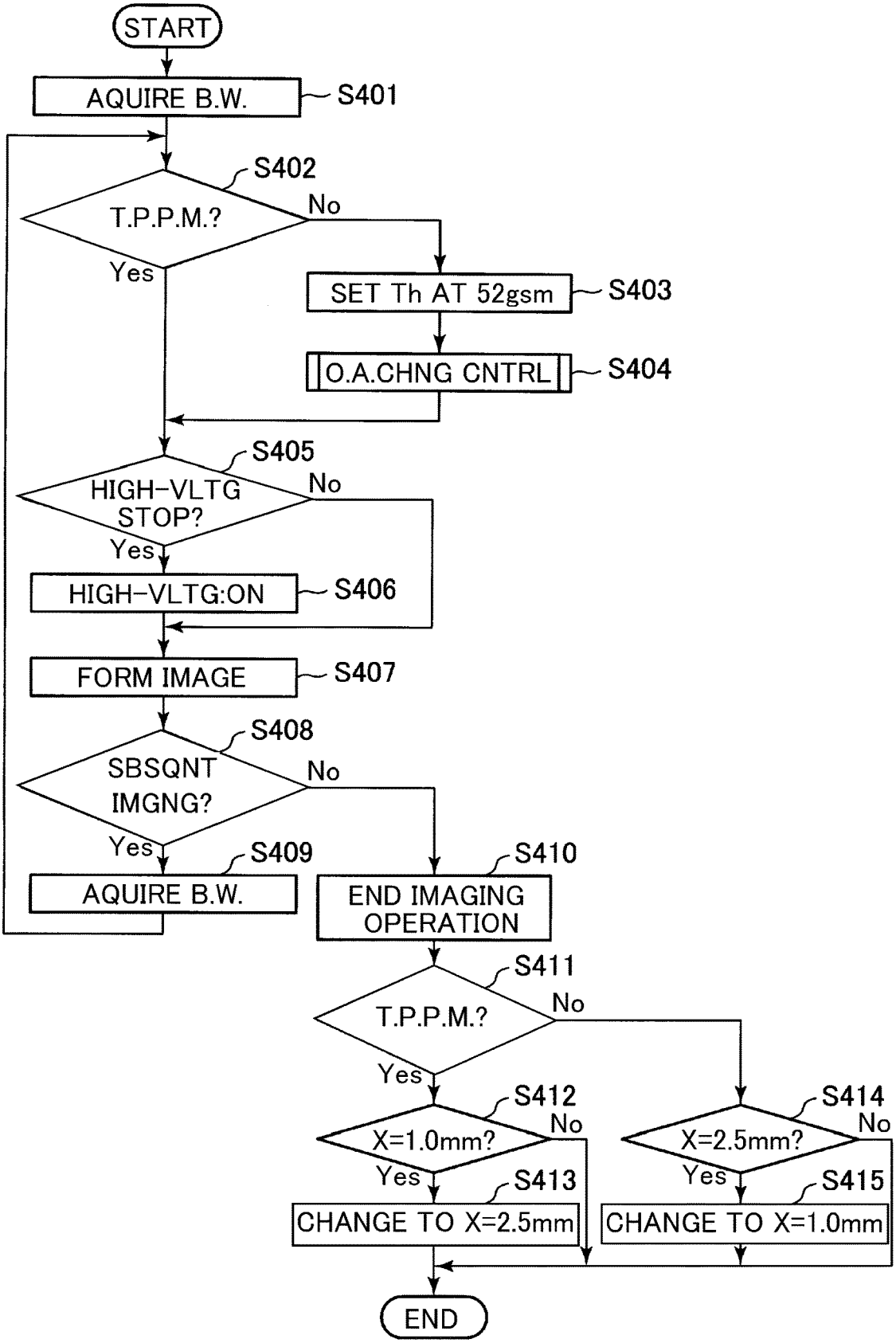

FIG. 15 is a flowchart of an operation of a job in an embodiment 3.

DESCRIPTION OF THE EMBODIMENTS

Embodiment 1

1. General Constitution and Operation of Image Forming Apparatus

Figure 1:
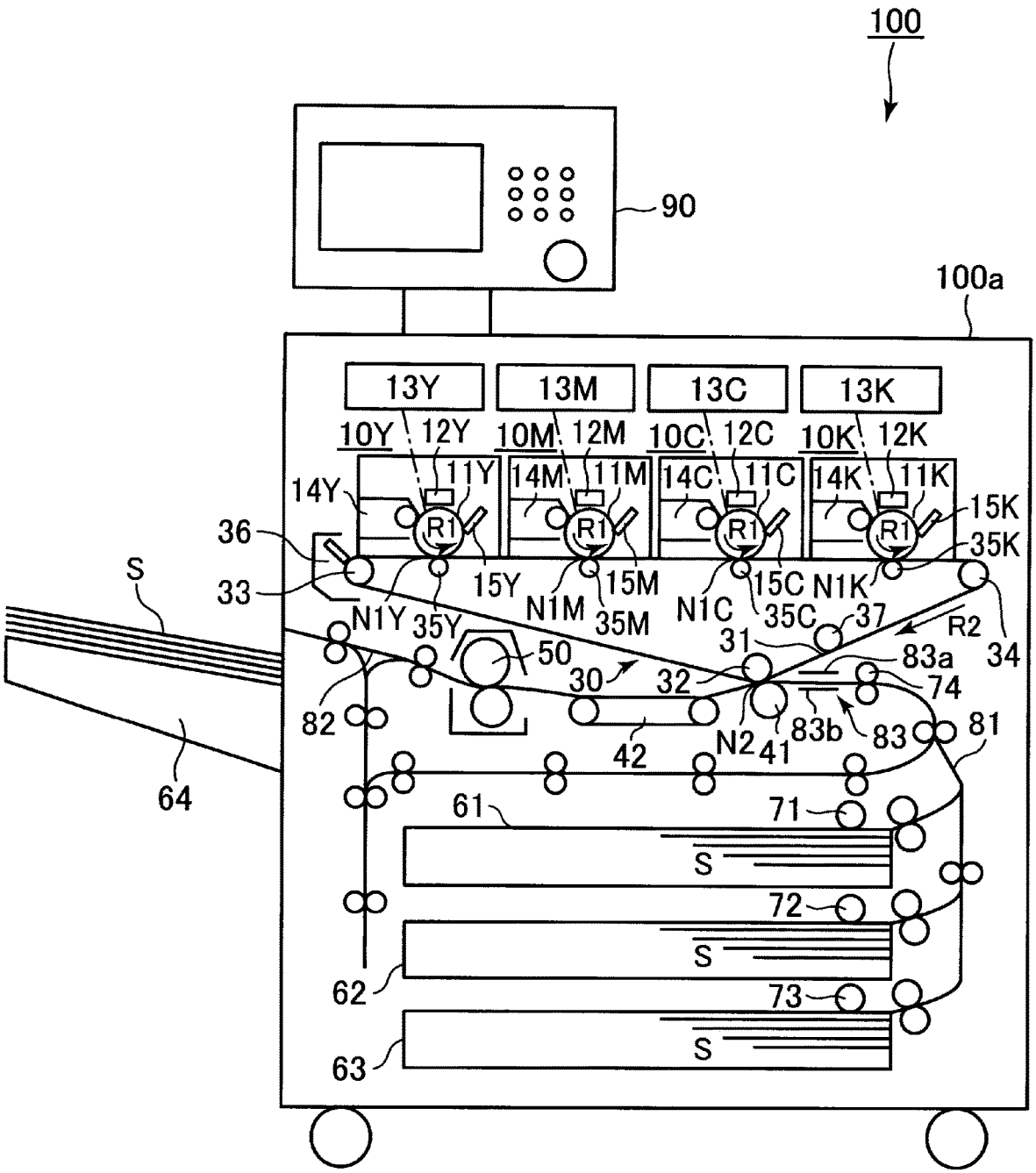
FIG. 1 is a schematic sectional view of an image forming apparatus.

FIG. 1 is a schematic sectional view of an image forming apparatus 100 of the present invention. The image forming apparatus 100 in this embodiment is a tandem multi-function machine (having functions of a copying machine, a printer and a facsimile machine) of an intermediary transfer type. For example, in accordance with an image signal sent from an external device, the image forming apparatus 100 is capable of forming a full-color image on a sheet-like recording material (a transfer material, a sheet material, a recording medium, media) such as paper by using electrophotographic type image forming.

The image forming apparatus 100 includes, as a plurality of image forming portions (stations), four image forming portions 10Y, 10M, 10C and 10K for forming images of yellow (Y), magenta (M), cyan (C) and black (K). These image forming portions 10Y, 10M, 10C and 10K are disposed in line along a movement direction of an image transfer surface disposed substantially parallel to an intermediary transfer belt 31. As regards elements of the image forming portions 10Y, 10M, 10C and 10K having the same or corresponding functions or constitutions, suffixes Y, M, C and K for representing the elements for associated colors are omitted, and the elements will be collectively described in some instances. In this embodiment, the image forming portion 10 is constituted by a photosensitive drum 11 (11Y, 11M, 11C, 11K), a charging device 12 (12Y, 12M, 12C, 12K), an exposure device 13 (13Y, 13M, 13C, 13K), a developing device 14 (14Y, 14M, 14C, 14K), a primary transfer roller 35 (35Y, 35M, 35C, 35K), a cleaning device 15 (15Y, 15M, 15C, 15K) and the like, which are described later.

As a second image bearing member for bearing the toner image, the intermediary transfer belt 31 which is a rotatable intermediary transfer member constituted by an endless belt is provided so as to oppose the four photosensitive drums 11Y, 11M, 11C and 11K. The intermediary transfer belt 21 is extended around and stretched by a plurality of stretching (supporting) rollers including a driving roller 33, a tension roller 34, a pre-secondary transfer roller 37 and an inner roller 32. The driving roller 33 transmits a driving force to the intermediary transfer belt 31. The tension roller 34 imparts predetermined tension to the intermediary transfer belt 31. The pre-secondary transfer roller 37 forms a surface of the intermediary transfer belt 31 in the neighborhood of a secondary transfer nip N2 (described later) on a side unit of the secondary transfer nip N2 with respect to a rotational direction (traveling direction, movement direction) of the intermediary transfer belt 31. The inner roller (secondary transfer opposite roller, inner member) 32 functions as an opposing member (opposite electrode) of an outer roller 41 (described later). The driving roller 33 is a rotationally driven by transmission of the driving force thereto from a belt driving motor (not shown) as a driving source. By this, the intermediary transfer belt 31 is rotated (circulated and moved) in an arrow R2 direction in FIG. 1. In this embodiment, the intermediary transfer belt 31 is rotationally driven so that a circumferential speed is 400 mm/sec as an example. Of the plurality of stretching rollers, the stretching rollers other than the driving roller 33 are rotated by rotation of the intermediary transfer belt 31.

On the inner peripheral surface side of the intermediary transfer belt 31, the primary transfer rollers 35Y, 35M, 35C and 35K which are roller-like primary transfer members as primary transfer means are disposed correspondingly to the respective photosensitive drums 11Y, 11M, 11C and 11K. The primary transfer roller 35 is urged toward an associated photosensitive drum 11 through the intermediary transfer belt 31, whereby a primary transfer nip N1 which is a contact portion between the photosensitive drum 11 and the intermediary transfer belt 31 is formed.

The toner image formed on the photosensitive drum 11 as described above is primary-transferred onto the rotating intermediary transfer belt 31 at the primary nip N1 by the action of the primary transfer roller 35. During the primary transfer, to the primary transfer roller 35, a primary transfer voltage which is a DC voltage of an opposite polarity to a normal charge polarity (the charge polarity of the toner during the development) of the toner is applied by an unshown primary transfer voltage source. For example, during full-color image formation, the color toner images of yellow, magenta, cyan and black formed on the respective photosensitive drums 11 are successively primary-transferred superposedly onto the same image forming region of the intermediary transfer belt 31. In this embodiment, the primary transfer nip N1 is an image forming position where the toner image is formed on the intermediary transfer belt 31. The intermediary transfer belt 31 is an example of an endless belt rotatable while feeding the toner image carried in the image forming position.

On an outer peripheral surface side of the intermediary transfer belt 31, at a position opposing the inner roller 32, an outer roller (secondary transfer roller, outer member) 41 which is a roller-like secondary transfer member (rotatable transfer member) as a secondary transfer means is provided. The outer roller 41 is urged toward the inner roller 32 through the intermediary transfer belt 31 and forms the secondary transfer nip N2 as a secondary transfer portion which is a contact portion between the intermediary transfer belt 31 and the outer roller 41. The toner images formed on the intermediary transfer belt 31 as described above are secondary-transferred onto a recording material S sandwiched and fed by the intermediary transfer belt 31 and the outer roller 41 at the secondary transfer portion N2 by the action of the outer roller 41. In this embodiment, during the secondary transfer, to the outer roller 41, a secondary transfer voltage which is a DC voltage of the opposite polarity to the normal charge polarity of the toner is applied by a secondary transfer voltage source (not shown). In this embodiment, the inner roller 32 is electrically grounded (connected to the ground). Incidentally, the inner roller 32 is used as a secondary transfer member and a secondary transfer voltage of the same polarity as the normal charge polarity of the toner is applied thereto, and the outer roller 41 is used as an opposite electrode and may also be electrically grounded.

The recording material S is fed to the secondary transfer nip N2 by being timed to the toner image on the intermediary transfer belt 21. That is, the recording materials S accommodated in recording material cassettes 61, 62 and 63 are sent by rotation of feeding rollers 71, 72 and 73, respectively, constituting a feeding device. The recording material S passes through a feeding (conveying) passage 81 and then is fed to a pair of registration rollers (registration roller pair) 74 which is a feeding member as a feeding means and is once stopped by the registration rollers 74. Then, this recording material S is sent into the secondary transfer nip N2 by rotational drive of the registration rollers 74 so that the toner image on the intermediary transfer belt 31 coincides with a desired image forming region on the recording material S in the secondary transfer nip N2.

With respect to the feeding direction of the recording material S, a feeding guide 83 for guiding the recording material S to the secondary transfer nip N2 is provided downstream of the registration roller pair 74 and upstream of the secondary transfer nip N2. The feeding guide 83 is constituted by a first guiding member 83*a* contactable to a front surface of the recording material S (i.e., a surface onto which the toner image is to be transferred immediately after the recording material S passes through the feeding guide 83 and a second guiding member 83*b* contactable to a back surface of the recording material S (i.e., a surface opposite from the front surface). The image guiding member 83*a* and the second guiding member 83*b* are disposed opposed to each other, and the recording material S passes through between these members. The first guiding member 83*a* restricts movement of the recording material S in a direction toward the intermediary transfer belt 31. The second guiding member 83*b* restricts movement of the recording material S in a direction away from the intermediary transfer belt 31.

The recording material S on which the toner images are transferred is fed by a feeding belt 42 toward a fixing device 50 as a fixing means. The fixing device 50 heats and presses the recording material S carrying thereon unfixed toner images, and thus fixes (melts) the toner images on the surface of the recording material P. Thereafter, the recording material S on which the toner images are fixed passes through a discharge feeding passage 82 and is discharged (outputted) to a discharge tray 64 provided on an outside of an apparatus main assembly 100*a* of the image forming apparatus 100.

On the other hand, toner (primary transfer residual toner) remaining on the photosensitive drum 11 after the primary transfer is removed and collected from the surface of the photosensitive drum 11 by a cleaning device 15 as a cleaning means. Further, deposited matters such as toner (secondary transfer residual toner) remaining on the intermediary transfer belt 31 after the secondary transfer, and paper powder guided from the recording material S are removed and collected from the surface of the intermediary transfer belt 31 by a belt cleaning device 36 as an intermediary member cleaning means.

Incidentally, in this embodiment, an intermediary transfer belt unit 30 as a belt feeding device is constituted by the intermediary transfer belt 31 stretched by the plurality of stretching rollers, the respective primary transfer rollers 35, the belt cleaning device 36, a frame supporting these members, and the like. The intermediary transfer belt unit 30 is mountable to and dismountable from the apparatus main assembly 100*a* for maintenance and exchange.

Incidentally, as the intermediary transfer belt 31, a belt constituted by a resin-based material formed in a single layer structure or a multi-layer structure including an elastic layer constituted by an elastic material can be used. Further, as the intermediary transfer belt 31, a belt of 40 μm or more in thickness, 1.0 GPa or more in Young's modulus, $1.0\times10^{9}$-$5.0\times10^{13}$ Ω/sq. in surface resistivity may preferably be used.

Further, in this embodiment, the inner roller 32 is constituted by providing an elastic layer (rubber layer) formed with a rubber material as an elastic material on an outer peripheral surface of a core metal (base material) made of metal. This elastic layer can be formed with an EPDM rubber (which may contain an electroconductive material), for example. In this embodiment, the inner roller 32 is formed so that an outer diameter thereof is 20 mm and a thickness of the elastic layer is 0.5 mm. Further, a hardness of the elastic layer of the inner roller 32 is set at, for example, about 70° (JIS-A). Incidentally, the inner roller 32 may also be constituted by a metal roller formed of a metal material such as SUM or SUS. The pre-secondary transfer roller 37 can be constituted, for example, similarly as in the case of the inner roller 32.

Further, in this embodiment, the outer roller 41 is constituted by providing an electroconductive elastic layer (which may also be a solid rubber layer or a sponge layer (elastic foam layer)) formed of an electroconductive rubber material as an electroconductive elastic material on an outer peripheral surface of a core metal (base material). This elastic layer can be formed with, for example, metal complex, NBR rubber containing an electroconductive agent such as carbon black or EPDM rubber. In this embodiment, the outer roller 41 is formed so that an outer diameter of the core metal is 12 mm and a thickness of the elastic layer is 6 mm and so that an outer diameter thereof is 24 mm. Further, in this embodiment, a hardness of the elastic layer of the outer roller 41 is set at, for example, about 28° (Asker-C). Further, the outer roller 41 is urged toward the inner roller 32 through the intermediary transfer belt 31 by pressing springs 44 (FIG. 3) which are urging members (elastic members) as urging means so that the outer roller 41 contacts the intermediary transfer belt 31 toward the inner roller 32.

In this embodiment, rotational axis directions of the stretching rollers including the inner roller 32 for the intermediary transfer belt 31 and the outer roller 41 are substantially parallel to each other.

2. Offset

Figure 2:
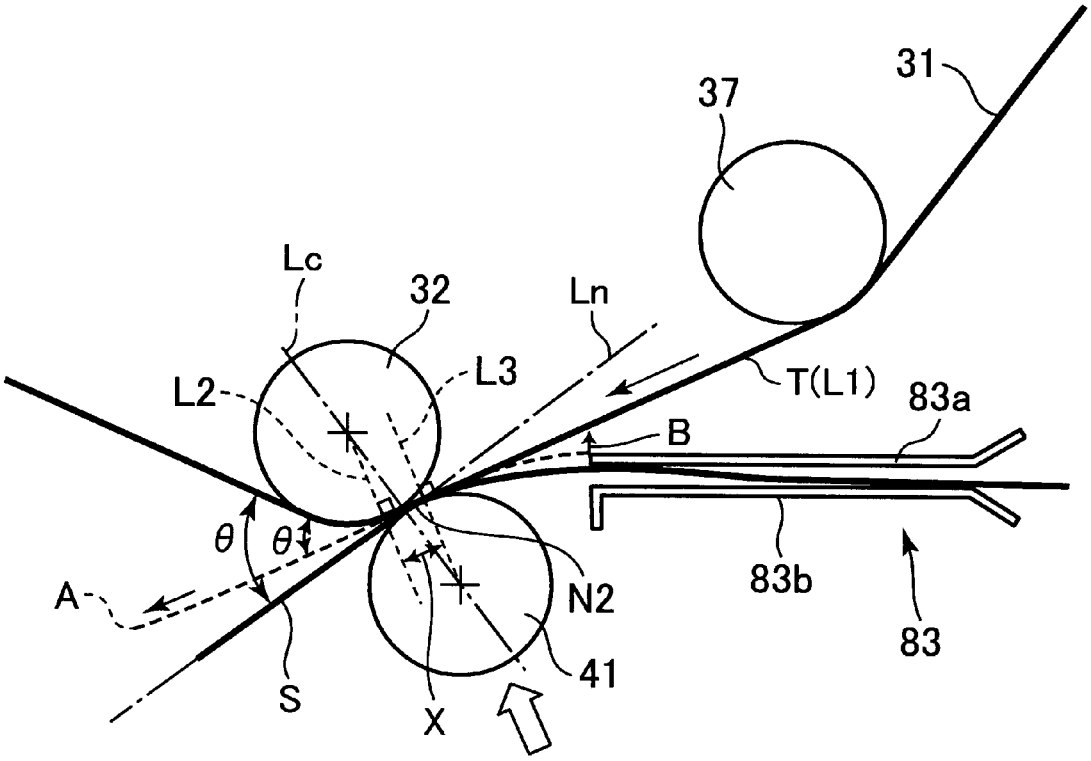
FIG. 2 is a schematic sectional view for illustrating behavior of a recording material in the neighborhood of a secondary transfer nip.

FIG. 2 is a schematic sectional view (of a cross section substantially perpendicular to the rotational axis direction of the inner roller 32) for illustrating behavior of the recording material S in the neighborhood of the secondary transfer nip N2.

As described above, depending on the rigidity of the shape (position) of the secondary transfer nip M2 and the rigidity of the recording material S, the behavior of the recording material S in the neighborhood of the secondary transfer nip N2 on sides upstream and downstream of the secondary transfer nip N2 with respect to the feeding direction of the recording material S changes. Further, for example, in the case where the recording material S is "thin paper" which is an example of paper small in rigidity, a jam (paper jam) occurs in some instances due to improper separation of the recording material P from the intermediary transfer belt 31. This phenomenon becomes conspicuous in the case where the rigidity of the recording material S is small since the recording material S is liable to stick to the intermediary transfer belt 31 due to weak resilience of the recording material S.

That is, in the cross section shown in FIG. 2, a line showing a stretching surface of the intermediary transfer belt 31 stretched and formed by the inner roller 32 and the pre-secondary transfer roller 37 is a pre-nip stretching line T. The pre-secondary transfer roller 37 in an example of the upstream rollers, of the plurality of stretching rollers, disposed adjacent to the inner roller 32 on a side upstream of the inner roller 32 with respect to the rotational direction of the intermediary transfer belt 31. Further, in the same cross section, a rectilinear line passing through a rotation center of the inner roller 32 and a rotation center of the outer roller 41 is a nip center line Lc. In the same cross section, a rectilinear line substantially perpendicular to the nip center line Le is a nip line Ln. Incidentally, FIG. 2 shows a state in which with respect to a direction along the pre-nip stretching line T, the rotation center of the outer roller 41 is offset and disposed on a side upstream of the rotation center of the inner roller 32 with respect to the rotational direction of the intermediary transfer belt 31.

At this time, there is a tendency that the recording material S is liable to maintain an attitude substantially along the nip line Ln in a state in which the recording material S is nipped between the inner roller 32 and the outer roller 41. For that reason, in general, in the case where the rotation center of the inner roller 32 and the rotation center of the outer roller 41 are close to each other with respect to the direction along the pre-nip stretching line T, as shown by a broken line A in FIG. 2, a discharge angle θ of the recording material P becomes small. That is, a leading end of the recording material S adopts an attitude such that the recording material S is discharged near the intermediary transfer belt 31 when the recording material S is discharged from the secondary transfer nip N2. By this, the recording material S is liable to stick to the intermediary transfer belt 31. On the other hand, in general, in the case where the rotation center of the outer roller 41 is disposed on a side more upstream of the rotation center of the inner roller 32 with respect to the pre-nip stretching line T, as shown by a solid line in FIG. 2, the discharge angle θ of the recording material S becomes large. That is, the leading end of the recording material S adept an attitude such that the recording material S is discharged in a direction away from the intermediary transfer belt 31 when the recording material S is discharged from the secondary transfer nip N2. By this, the recording material S does not readily stick to the intermediary transfer belt 31.

On the other hand, for example, in the case where the recording material S is "thick paper" which is an example of a recording material S large in rigidity, when a trailing end of the recording material S with respect to the feeding direction of the recording material S passes through the feeding guide 83, a trailing end portion of the recording material S collides with the intermediary transfer belt 31 in some instances. By this, an image defect occurs at the trailing end portion of the recording material S with respect to the feeding direction in some instances. This phenomenon becomes conspicuous in the case where the rigidity of the recording material S is large since due to storing resilience of the recording material S, the trailing end portion of the recording material S with respect to the feeding direction is liable to vigorously collide with the intermediary transfer belt 31.

That is, as described above, in the cross section shown in FIG. 2, in a state in which the recording material S is nipped between the inner roller 32 and the outer roller 41 in the secondary transfer nip N2, there is a tendency that the recording material S is liable to maintain the attitude thereof substantially along the nip line Ln. For that reason, in general, the nip line Ln approaches and contacts the pre-nip stretching line T as with respect to the direction along the pre-nip stretching line T, the rotation center of the outer roller 41 is disposed on a side more upstream than the rotation center of the inner roller 32 in the rotational direction of the recording material S. As a result, when the trailing end of the recording material S with respect to the feeding direction passed through the feeding guide 83, as shown by a broken line B in FIG. 2, the trailing end portion of the recording material S collides with the intermediary transfer belt 31, so that the image defect is liable to occur at the trailing end portion of the recording material S with respect to the feeding direction. On the other hand, in general, when the rotation center of the inner roller 32 and the rotation center of the outer roller 41 are brought near to each other with respect to the direction along the pre-nip stretching line T, collision of the recording material S with the intermediary transfer belt 31 when the trailing end of the recording material S with respect to the feeding direction passed through the feeding guide 83 is suppressed. By this, the image defect at the trailing end portion of the recording material S with respect to the feeding direction does not readily occur.

Accordingly, in order to realize improvement in separating property of the recording material S from the intermediary transfer belt 31 and suppression of the image defect at the trailing end portion of the recording material S with respect to the feeding direction, the following is effective. That is, depending on the kind of the recording material S, a relative position between the inner roller 32 and the outer roller 41 with respect to a circumferential direction of the inner roller 32 (the rotational direction of the intermediary transfer belt 31) is changed, so that the shape (position) of the secondary transfer nip N2 is changed.

With reference to FIG. 2, definition of an offset amount X indicating the relative position between the inner roller 32 and the outer roller 41 will be described. In the cross section shown in FIG. 2, a common tangential line of the inner roller 32 and the pre-secondary transfer roller 37 on a side where the intermediary transfer belt 31 is extended around the stretching rollers is a reference line L1. The reference line L1 corresponds to the pre-nip stretching line T. Further, in the same cross section, a rectilinear line which passes through the rotation center of the inner roller 32 and which is substantially perpendicular to the reference line L1 is referred to as an inner roller center line L2. Further, in the same cross section, a rectilinear line which passes through the rotation center of the outer roller 41 and which is substantially perpendicular to the reference line L1 is referred to as an outer roller center line L3. At this time, a distance (vertical distance) between the inner roller center line L2 and the outer roller center line L3 is the offset amount X (in this case, the offset amount X is a positive value when the outer roller center line L3 is on the side upstream of the inner roller center line L2 with respect to the rotational direction of the intermediary transfer belt 31. The offset amount X can be a negative value, zero and the positive value. By making the offset amount X large, a width of the secondary transfer nip N2 with respect to the rotational direction of the intermediary transfer belt 31 extends toward an upstream side of the rotational direction of the intermediary transfer belt 31. That is, with respect to the rotational direction of the intermediary transfer belt 31, an upstream end portion of a contact region between the outer roller 41 and the intermediary transfer belt 31 is positioned on an upstream side than an upstream end portion of a contact region between the inner roller 32 and the intermediary transfer belt 31 is. Thus, by changing a position of at least one of the inner roller 32 and the outer roller 41, the relative position between the inner roller 32 and the outer roller 41 with respect to the circumferential direction of the inner roller 32 is changed, so that the position of the secondary transfer nip (transfer portion) N2 is changeable.

In FIG. 2, the outer roller 41 is illustrated so as to virtually contact the reference line L1 (pre-nip stretching line T) without being deformed. However, a material of an outermost layer of the outer roller 41 is an elastic member such as a rubber or a sponge, so that in actuality, the outer roller 41 is pressed and deformed toward the inner roller 32 by the pressing spring 44. When the outer roller 41 is offset and disposed toward the upstream side with respect to the rotational direction of the intermediary transfer belt 21 relative to the inner roller 32 and is pressed by the pressing spring 44 so as to nip the intermediary transfer belt 31 between itself and the inner roller 32, the secondary transfer nip N2 in a substantially S shape is formed. Further, the attitude of the recording material S guided and sent to the feeding guide 83 is also determined in conformity to the shape of the secondary transfer nip N2. With an increasing offset amount X, a degree of bending of the recording material S increases. For that reason, as described above, for example, in the case where the recording material S is the "thin paper", by making the offset amount X large, the separating property of the recording material P, from the intermediary transfer belt 31, passed through the secondary transfer nip N2 can be improved. However, when the offset amount X is large, as described above, in the case where for example, the recording material S is the "thick paper", when the trailing end of the recording material S with respect to the recording material feeding direction passed through the feeding guide 83, the collision of the trailing end portion of the recording material S with respect to the recording material feeding direction with the intermediary transfer belt 31 is liable to occur. This causes a lowering in image quality of the trailing end portion of the recording material S with respect to the recording material feeding direction. For this reason, in this case, it may only be required that the offset amount X is made small.

In this embodiment, the image forming apparatus 100 has a constitution capable of changing the offset amount X by changing the position of at least one of the inner roller 32 or the outer roller 41. Particularly, in this embodiment, the image forming apparatus 100 changes the offset amount X on the basis of information on a basis weight of the recording material (paper) S as information on the kind of the recording material S relating to rigidity of the recording material S.

In this embodiment, in an operation of the image forming apparatus 100 in a "normal mode" described specifically later, in the case where the recording material S is the "plain paper" or the "thick paper" ((basis weight≥52 gsm), the inner roller 32 is disposed in a first inner roller position where the offset amount X is a first offset amount X1. Further, in this embodiment, in an operation of the image forming apparatus 100 in the "normal mode", in the case where the recording material S is the "thin paper" ((basis weight)<52 gsm), the inner roller 32 is disposed in a second inner roller position where the offset amount X is a second offset amount X2 larger than the first offset amount X1. The first offset amount X1 may be a positive value, zero and a negative value, and the second offset amount X2 is typically a positive value. In this embodiment, the relative position between the inner roller 32 and the outer roller 41 in the case where the offset amount X is the first offset amount X1 is a first relative position, and the relative position between the inner roller 32 and the outer roller 41 in the case where the offset amount X is the second offset amount X1 is a second relative position. In other words, the position of the secondary transfer nip N2 in the case where the offset amount X is the first offset amount X1 is a first position of the transfer portion, and the position of the secondary transfer nip N2 in the case where the offset amount X is the second offset amount X2 is a second position of the transfer portion.

Incidentally, the offset amount X may also be required to be a desired offset amount X when the recording material S passes through the secondary transfer nip N2 (during the secondary transfer).

2. Constitution Relating to a Secondary Transfer

A constitution relating to the secondary transfer in this embodiment will be described specifically. In this embodiment, the operation in the "normal mode" described specifically later will be described. Parts (a) and (b) of FIG. 3 are schematic side views of a principal part of the neighborhood of the secondary transfer nip N2 in this embodiment as seen substantially in parallel to the rotational axis direction on one end portion side (the front (surface) side in FIG. 1) with respect to the rotational axis direction of the inner roller 32. Part (a) of FIG. 3 shows a state of the case of the "plain paper" and the "thick paper" ((basis weight)≥52 gsm), and part (b) of FIG. 3 shows a state of the case of the "thin paper" ((basis weight)<52 gsm). Incidentally, for example, the cases of the "thin paper" and the "thick paper" refer to the cases where the "thin paper" and the "thick paper" are used as the recording materials S and pass through the secondary transfer nip N2.

3. Offset Mechanism

As shown in parts (a) and (b) of FIG. 3, in this embodiment, the image forming apparatus 100 includes the offset mechanism (offset amount changing mechanism) 101 as a position changing mechanism for changing the offset amount by changing the relative position of the inner roller 32 to the outer roller 41. In parts (a) and (b) of FIG. 3, a structure of the inner roller 32 at one end portion of the inner roller 32 with respect to the rotational axis direction is shown, but a structure of the inner roller 32 at the other end portion is also the same (i.e., these (opposite) end portions are substantially symmetrical to each other with respect to a center of the inner roller 32 with respect to the rotational axis direction).

The opposite end portions of the inner roller 32 with respect to the rotational axis direction are rotatably supported by an inner roller holder 38 as a supporting member. The inner roller holder 38 is supported by a frame or the like of the intermediary transfer belt unit 30 so as to be rotatable about an inner roller rotation shaft 38*a*. Thus, the inner roller holder 38 is rotated about the inner roller rotation shaft 38*a*, so that the inner roller 32 is rotated about the inner roller rotation shaft 38*a*, so that the relative position of the inner roller 32 to the outer roller 41 is changed and thus the offset amount X can be changed.

The inner roller holder 38 is constituted so as to be rotated by the action of an offset cam 39 as an acting member. The offset cam 39 is supported by the frame or the like of the intermediary transfer belt unit 30 so as to be rotatable about the offset cam rotation shaft 39*a*. The offset cam 39 is rotatable about the offset cam rotation shaft 39*a* by receiving the driving force (drive) from an inner roller driving motor 250 as a driving source. Further, the offset cam 39 contacts an offset cam follower (arm portion) 38*c* provided as a part of the inner roller holder 38. Further, the inner roller holder 38 is urged by tension of the intermediary transfer belt 21 in this embodiment as described later so that the offset cam follower 38*c* rotates in a direction in which the offset cam follower 38*c* engages with the offset cam 39. However, the present invention is not limited thereto, but the inner roller holder 38 may also be urged by a spring or the like which is an urging member (elastic member) as an urging means.

As shown in part (a) of FIG. 3, in the case of the "plain paper" and the "thick paper" ((basis weight)≥52 gsm), the offset cam 39 is rotated, for example, clockwise by being driven by the inner roller driving motor g2503. By this, the inner roller holder 38 is rotated counterclockwise about the inner roller rotation shaft 38*a*, so that the relative position of the inner roller 32 to the outer roller 41 is determined. By this, the inner roller 32 is disposed in a state in which the inner roller 32 is in the first inner roller position where the offset amount X is the first offset amount X1 relatively small. As a result, as described above, it is possible to suppress a lowering in image quality at the trailing end portion of the recording material P with respect to the feeding direction of the "plain paper" and the "thick paper" ((basis weight)≥52 gsm).

As shown in part (b) of FIG. 3, in the case of the "thin paper" ((basis weight)>52 gsm), the offset cam 39 is rotated, for example, counterclockwise by being driven by the inner roller driving motor 250. By this, the inner roller holder 38 is rotated clockwise about the inner roller rotation shaft 38*a*, so that the relative position of the inner roller 32 to the outer roller 41 is determined. By this, the inner roller 32 is disposed in a state in which the inner roller 32 is in the second inner roller position where the offset amount X is the second offset amount X2 relatively large. As a result, as described above, the separating property of the "thin paper" ((basis weight)>52 gsm), from the intermediary transfer belt 31, passed through the secondary transfer nip N2 is improves.

In this embodiment, in the operation in the "normal mode", on the basis of a basis weight M (gsm) of the recording material S, the offset amounts X (X1, X2) are set at, for example, the following two patterns.

(a) M≥52 gsm: X1=1.0 mm (b) M<52 gsm: X2=2.5 mm

In this embodiment, the position of the inner roller 32 in the above setting (a) shown in part (a) of FIG. 3 is a home position of the inner roller 32. Here, the home position refers to a position when the image forming apparatus 100 is in a sleep state (described later) or when a main switch (main power source) is turned off.

Here, in this embodiment, in the cross sections shown in parts (a) and (b) of FIG. 3, to the inner roller holder 38, counterclockwise moment about the inner roller rotation shaft 38*a* is always exerted by the tension of the intermediary transfer belt 31. That is, in this embodiment, by the tension of the intermediary transfer belt 31, moment in a direction in which the offset cam follower 38*c* rotates so as to engage with the offset cam 39 is always exerted on the inner roller holder 38. Further, in this embodiment, in the cross-section shown in parts (a) and (b) of FIG. 3, the inner roller rotation shaft 38*a* is disposed on a side downstream, with respect to the feeding direction of the recording material S, of the rectilinear line (nip center line) Lc connecting the rotation center of the inner roller 32 and the rotation center of the outer roller 41. By this, in the case where the outer roller 41 is contacted to the intermediary transfer belt 31 toward the inner roller 32, reaction force received by the inner roller holder 38 from the outer roller 41 also constitutes the counterclockwise moment in parts (a) and (b) of FIG. 3. By such a constitution, the cam mechanism can be constituted without separately using an urging member such as a spring.

Further, in order to exchange the intermediary transfer belt 31, the inner roller holder 38 may desirably be disposed inside the stretching surface of the intermediary transfer belt 31 so as not to impair operativity of an operation in which the intermediary transfer belt 31 is mounted in or dismounted from the intermediary transfer belt unit 30. For that reason, in the cross section shown in parts (a) and (b) of FIG. 3, the inner roller rotation shaft 38*a* may desirably be disposed in a region A between the above-described rectilinear line (nip center line) Lc and a post-nip stretching line U. Here, the post-nip stretching line U is a line indicating the stretching surface of the intermediary transfer belt 31 stretched and formed by the inner roller 32 and the driving roller 33 (FIG. 1) in the cross section shown in parts (a) and (b) of FIG. 3. Incidentally, the driving roller 33 is an example of the downstream rollers, of the plurality of stretching rollers, disposed downstream of and adjacent to the inner roller 32 with respect to the rotational direction of the intermediary transfer belt 31.

FIG. 4 is a schematic side view of the inner roller holder 38 and the neighborhood thereof as seen in substantially parallel to the rotational axis direction of the inner roller 32 on the one end portion side (the front side on the drawing sheet of FIG. 1) with respect to the rotational axis direction. In this embodiment, the image forming apparatus 100 is provided with an inner roller position sensor 251 as a position detecting means for detecting a relative position (particularly the position of the inner roller 32 in this embodiment) between the inner roller 32 and the outer roller 41. In this embodiment, the inner roller position sensor 251 is constituted by a transmission optical sensor. This inner roller position sensor 251 detects a state of transmission or block of light by a part of the inner roller holder 38 and then inputs, to a controller 300 described later, an output signal indicating a detection result.

A state shown by a solid line in FIG. 4 is a state of the position of the inner roller 32 corresponding to the "plain paper" and the "thick paper" ((basis weight)≥52 gsm). In this state, as described above, by the tension of the intermediary transfer belt 31 and the reaction force received from the outer roller 41, the inner roller holder 38 receives the counterclockwise moment about the inner roller rotation shaft 38*a*. Then, a cylindrical abutment portion 38*b* provided as a part of the inner roller holder 38 coaxially with the inner roller 32 abuts against a first positioning portion 40*a*. When the abutment portion 38*b* abuts against the first positioning portion 40*a*, the inner roller position sensor 251 detects light transmission by the abutment of the inner roller holder 38. When a CPU 301 of the controller 300 described later causes the inner roller driving motor 250 and detects that logic of the output signal of the inner roller position sensor 251 was changed from Low to High, the CPU 301 discriminates that the inner roller 32 reaches a position of the first offset amount X1. Then, the CPU 301 stops the drive of the inner roller driving motor 250. Thus, the inner roller 32 is positioned in the position of the first offset amount X1 (=1.0 mm). On the other hand, a state shown by a chain double-dashed line in FIG. 4 is a state of the "thin paper" (((basis weight)>52 gsm). By rotation of the offset cam 39, the offset cam 39 contacts and passes the arm portion 38*c* of the holder 38, so that the abutment portion 38*b* abuts against a second positioning portion 40*b*. By this, the inner roller 32 is positioned in a position of the second offset amount X2 (=2.5 mm). At this time, the CPU 301 of the controller 300 drives the inner roller driving motor 250, and when 500 msec has elapsed from detection of a change in logic of the output signal of the inner roller position sensor 251 from High to Low, the CPU 301 causes the inner roller driving motor 250 to top the drive thereof. By this, the CPU 301 discriminates that the inner roller 32 reaches a position of the second offset amount X2 (=2.5 mm). Incidentally, the first and second positioning portions 40*a* and 40*b* are provided on a frame of the intermediary transfer belt unit 30 or the like.

In this embodiment, the offset mechanism 101 is constituted by the inner roller holder 38, the offset cam 39, the inner roller driving motor 250, the inner roller position sensor 251 and the like, which are described above.

3-2. Contact-and-Separation Mechanism

Opposite end portions of the outer roller 41 with respect to the rotational axis direction are rotatably supported by bearings 43. The bearings 43 are supported by a frame or the like of the apparatus main assembly 100*a* so as to be slidable (movable) in a discriminate toward the inner roller 32 and an opposite direction thereto along a predetermined direction (for example, the direction substantially perpendicular to the above-described reference line L1). The bearings 43 are pressed toward the inner roller 32 by pressing springs 44 constituted by compression springs which are urging members (elastic members) as urging means. By this, the outer roller 41 contacts the intermediary transfer belt 31 toward the inner roller 32 and forms the secondary transfer nip N2.

Further, in this embodiment, the image forming apparatus 100 includes a contact-and-separation mechanism (contact-and-separation means) 102 for moving the outer roller 41 toward and away from the intermediary transfer belt 31. As shown in FIG. 5, the contact-and-separation mechanism 102 is constituted by a contact-and-separation arm 122, a contact-and-separation cam 121, a contact-and-separation motor 252 and the like. The contact-and-separation arm 122 is supported by the frame or the like of the apparatus main assembly 100*a* so as to be rotatable about a contact-and-separation rotation shaft 122*a* and engages with the bearings 43. Further, the contact-and-separation arm 122 is constituted so as to be rotated by the action of the contact-and-separation cam 121 as an acting member. The contact-and-separation cam 121 is supported by the frame or the like of the apparatus main assembly 100*a* so as to be rotatable about a contact-and-separation cam rotation shaft 120. The contact-and-separation cam 121 is rotatable about the contact-and-separation cam rotation shaft 120 by receiving drive (driving force) from the contact-and-separation motor 252 as a driving source. Further, the contact-and-separation cam 121 contacts a contact-and-separation cam follower 122*b* provided as a part of the contact-and-separation arm 122. Further, the contact-and-separation arm 122 is urged so as to be rotated by the pressing spring 44 in a direction in which the contact-and-separation cam follower 122*b* engages with the contact-and-separation cam 121.

The contact-and-separation mechanism 102 moves the outer roller 41 in directions in which the outer roller 41 is moved toward and away from the inner roller 32. As shown by a solid line in FIG. 5, when the outer roller 41 is separated from the intermediary transfer belt 31, the contact-and-separation cam 121 is rotated counterclockwise, for example, by being driven by the contact-and-separation motor 252, so that the contact-and-separation arm 122 is rotated clockwise. By this, the contact-and-separation arm 122 moves the bearings 43 in a direction away from the inner roller 32 (downward) against the urging force of the pressing springs 44, so that the outer roller 41 is separated from the intermediary transfer belt 31. On the other hand, as shown by a chain double-dashed line in FIG. 5, when the outer roller 41 is contacted to the intermediary transfer belt 31, the contact-and-separation cam 121 is rotated, for example, clockwise by being driven by the contact-and-separation motor 252, so that the contact-and-separation arm 122 is rotated counterclockwise by the urging force of the pressing springs 44. By this, the contact-and-separation arms 122 moves the bearings 43 in a direction toward the inner roller 32 (upward), so that the outer roller 41 is contacted to the intermediary transfer belt 31.

In this embodiment, the contact-and-separation mechanism 102 separates the outer roller 41 from the intermediary transfer belt 31 in order to avoid deposition of the toner, on the surface of the outer roller 41, which does not transfer onto the recording material S in the form of a test image (patch), for image density correction or color misregistration correction, formed on the intermediary transfer belt 31. Further, the contact-and-separation mechanism 102 separates the outer roller 41 from the intermediary transfer belt 31 also when a jam (paper jam) clearance is carried out. Further, when the outer roller 41 is continuously pressed toward the inner roller 32 after the job is ended, the inner roller 32 and the controller 41 are deformed in some cases. Therefore, in this embodiment, the contact-and-separation mechanism 102 separates the outer roller 41 from the intermediary transfer belt 31 when the job is ended and the image forming apparatus 100 is in a stand-by state in which the image forming apparatus 100 stands by for a subsequent job. Also, when the image forming apparatus 100 is in a sleep state or in a state in which a main switch thereof is turned off, the outer roller 41 is kept at a state in which the outer roller 41 is separated from the intermediary transfer belt 31.

Incidentally, the offset mechanism 101 may also be constituted so as to be capable of performing the offset amount X changing operation in either of the state in which the outer roller 41 is contacted to the intermediary transfer belt 31 and the state in which the outer roller 41 is separated from the intermediary transfer belt 31. Further, the offset mechanism 101 may also be constituted so as to be capable of performing the offset amount X changing operation in either of a state in which the intermediary transfer belt 31 is at rest and a state in which the intermediary transfer belt 31 is rotated. From the viewpoint of suppression of damage (scars) of the surface of the intermediary transfer belt 31, the offset amount X changing operation may desirably be performed in the state in which the intermediary transfer belt 31 is at rest, further desirably be performed in the state in which the outer roller 41 is separated from the intermediary transfer belt 31.

4. Details of Change in Offset Amount X

Next, the change in offset amount X depending on the basis weight of the recording material S in this embodiment will be described further specifically.

4-1. Normal Mode

A table 1 below shows a relationship between the basis weight of the recording material S, and occurrence status of improper separation of the recording material S from the intermediary transfer belt 31 and an image defect at the trailing end portion of the recording material S with respect to the recording material feeding direction (also simply referred to as a "trailing end portion image defect"). A part (a) of table 1 shows the relationship in the case where the offset amount X is the first offset amount X1 (=1.0 mm), and a part (b) of the table 1 shows the relationship in the case where the offset amount X is the second offset amount X2 (=2.5 mm).

TABLE 1

| | | | |
|---|---|---|---|
| (a) X = 1.0 mm | | | |
| | ≤ 51 gsm | 52 gsm - 349 gsm | 350 gsm < |
| JAM*1 | OC*3 | NOC*4 | NOC*4 |
| ID*2 | NOC*4 | NOC*4 | NOC*4 |
| (b) X = 2.5 mm | | | |
| | ≤ 51 gsm | 52 gsm - 349 gsm | 350 gsm < |
| JAM*1 | NOC*3 | NOC*4 | NOC*4 |
| ID*2 | NOC*4 | NOC*4 | OC*4 |

*1: "JAM" is the job due to the improper separation.
*2: "ID" is the image defect at the trailing end portion of the recording material S.
*3: "OC" is "occurred".
*4: "NOC" is "not occurred".

As shown in the part (a) of the table 1, in the case where the offset amount X is set at the first offset amount X1 (=1.0 mm), the trailing end portion image defect does not occur on all the recording materials S with the basis weights which are usable in the image forming apparatus 100 of this embodiment. However, in this case, the improper separation occurs for the "thin paper" of less than 52 gsm (45 gsm to 51 gsm) in basis weight. On the other hand, as shown in the part (b) of the table 1, in the case where the offset amount X is set at the second offset amount X2 (=2.5 mm), the improper separation does not occur for all the recording materials S with the basis weights which are usable in the image forming apparatus 100 of this embodiment. However, in this case, the trailing end portion image defect occurs on the "thick paper" of not less than 350 gsm (350 gsm to 400 gsm) in basis weight.

For that reason, in this embodiment, in the operation in the "normal mode" of the image forming apparatus 100, in the case of the "thin paper" of less than 52 gsm in basis weight, the occurrence of the improper separation is suppressed by setting the offset amount X at the second offset amount X2 (=2.5 mm). Further, in this embodiment, in the operation in the "normal mode" of the image forming apparatus 100, in the case of the "plain paper" and the "thick paper" which are not less than 52 gsm in basis weight, the occurrence of the trailing end portion image defect is suppressed by setting the offset amount X at the first offset amount X1 (=1.0 mm). That is, in the operation in the "normal mode", the offset amount X is set at the first offset amount X1 when the basis weight of the recording material S is a first threshold (=52 gsm) or more and is set at the second offset amount X2 when the basis weight of the recording material S is less than the first threshold (=52 gsm).

4-2. Productivity Priority Mode

In the image forming apparatus using an electrophotographic type or the like, for example, in order to perform bookbinding printing, a job ("mixed job") for forming images on a plurality of kinds of recording materials S is executed in some instances. For example, the case where the recording material S are changed between "thin paper" (for example, 45 gsm in basis weight) and "plain paper" (for example, 80 gsm in basis weight) and the like case exist. In the case here when such a mixed job is executed, when the offset amount X is changed by using a certain (predetermined) threshold as in the above-described "normal mode", the offset amount X is frequently changed during the job in some instances. In the constitution of this embodiment, in the case where the offset amount X is changed during the job, before the inner roller 32 is moved, application of high voltages for an image forming system, such as the charging voltage, the developing voltage, the primary transfer voltage and the secondary transfer voltage is stopped in some instances. Further, it would be also considered that rotation of the intermediary transfer belt 31 is stopped and that the outer roller 41 is separated from the intermediary transfer belt 31. For that reason, when the change in offset amount X is excessively made frequently, there is a liability that productivity lowers. Further, when the change in offset amount X is excessively made frequently, there is a liability that abrasion and deterioration of the intermediary transfer belt 31, the inner roller 32 or the outer roller 41 are accelerated.

Here, as shown in the parts (a) and (b) of the table 1, in the case of the recording materials with the basis weight of 52 gsm or more and less than 350 gsm (52 gsm to 349 gsm), in either of the first offset amount X1 (=1.0 mm) and the second offset amount X2 (=2.5 mm), the improper separation and the trailing end portion image defect do not occur. Specifically, in the case of the recording material S with the basis weight of 52 gsm or more and less than 350 gsm (52 gsm to 349 gsm), when the offset amount X is the second offset amount X2 (=2.5 mm), the trailing end portion image defect occurs in some rare cases. For that reason, when priority is given to image quality, in the case of the recording material S with the basis weight of 52 gsm or more and less than 350 gsm (52 gsm to 349 gsm), the offset amount X may preferably be the first offset amount X1 (=1.0 mm). However, when priority is given to productivity (speed), in the case of the recording material S with the basis weight of 52 gsm or more and less than 300 gsm (52 gsm to 349 gsm), the offset amount X may be either of the first offset amount (=1.0 mm) and the second offset amount X2 (=2.5 mm).

Therefore, in this embodiment, the image forming apparatus 100 is constituted so as to be capable of executing the job in a "normal mode" or ("image quality priority mode)" as a first mode and in a "productivity priority mode" as a second mode. In the "normal mode", as a threshold of the basis weight of the recording material S for changing the offset amount X, the above-described first threshold (=52 gsm) is used. In the "productivity priority mode", as the threshold of the basis weight of the recording material S for changing the offset amount, the first threshold (=52 gsm) and a second threshold (=350 gsm) different from the first threshold (=52 gsm) are used. Further, in the "productivity priority mode", depending on a current offset amount X (the position of the inner roller 32), the first threshold or the second threshold is used in a switching manner. Specifically, in the case where the current offset amount X is the first offset amount X1 (=1.0 mm) corresponding to the "thick paper" (or the "plain paper"), the first threshold (=52 gsm) is used. Further, in the case where the current offset amount X is the second offset amount X2 (=2.5 mm), the second threshold (=350 gsm) larger than the first threshold (=52 gsm) is used. By this, in the "productivity priority mode", compared with the "normal mode" using only the first threshold, the frequency of the change in offset amount X can be decreased. As a result, in the "productivity priority mode", compared with the "normal mode", it becomes possible to suppress a lowering in productivity.

Thus, in this embodiment, in order to suppress the lowering in productivity, the "productivity priority mode" in which as the threshold of the recording material S basis weight for changing the offset amount X, the plurality of thresholds are used in the switching manner is provided. By this, it becomes possible to reduce the frequency of the change in offset amount X in the mixed job.

Part (a) of FIG. 6 is a schematic view showing a changing condition of the offset amount X in the "normal mode". In the "normal mode", the offset amount X is changed depending on whether or not the basis weight of the recording material S is the first threshold (=52 gsm) or more. In the "normal mode", in the case where the image is printed on the "thin paper" (for example, basis weight: 45 gsm), the printing is carried out at the second offset amount X2 (=2.5 mm) as the offset amount X, and in the case where the image is printed on the "plain paper" (for example, basis weight: 80 gsm), the printing is carried out at the first offset amount X1 (=1.0 mm) as the offset amount X.

Part (b) of FIG. 6 is a schematic view showing a changing condition of the offset amount X in the "productivity priority mode". In the "productivity priority mode", depending on the current offset amount X, the changing condition of the offset amount X is switched. In the case where the current offset amount X is the second offset amount X2 (=2.5 mm), the offset amount X is not changed unless the recording material S is changed to the recording material S with the basis weight which is the second threshold (=350 gsm) or more. For that reason, even in the case where the image is printed on the "plain paper" (for example, basis weight: 80 gsm) after the image is printed on the "thin paper" (for example, basis weight: 45 gsm), the change in offset amount X is not made. This is for the following reason. That is, as shown in the part (b) of the table 1, in the case of the second offset amount X2 (=2.5 mm), when the basis weight of the recording material S is 350 gsm or more, there is a possibility that the tailing end portion image defect occurs. However, with case of the recording material S of less than 350 gsm in basis weight, the trailing end portion image defect does not occur, and therefore, there is no need to change the offset amount X.

Further, as shown in part (b) of FIG. 6, in the "productivity priority mode", in the case where the current offset amount X is the first offset amount X1 (=1.0 mm), the offset amount X is not changed unless the recording material S is changed to the recording material S with the basis weight which is less than the first threshold (=52 gsm). For that reason, even in the case where the image is printed on the "plain paper" (for example, basis weight: 80 gsm) after the image is printed on the "thick paper" (for example, basis weight: 400 gsm), the change in offset amount X is not made. This is for the following reason. That is, as shown in the part (a) of the table 1, in the case of the first offset amount X1 (=1.0 mm), when the basis weight of the recording material S is less than 52 gsm, there is a possibility that the improper separation occurs. However, with case of the recording material S of 52 gsm or more in basis weight, the improper separation does not occur, and therefore, there is no need to change the offset amount X.

Thus, in this embodiment, the image forming apparatus 100 includes the offset mechanism 101 capable of changing the rotational direction between the inner roller 32 and the outer roller 41 with respect to a circumferential direction of the inner roller 32, between a first relative position and a second relative position where the inner roller 32 is positioned on a side more downstream of the outer roller 41 than the inner roller 32 positioned in the first relative position is. Further, when a continuous image forming job is executed, the controller 300 (described later) is capable of controlling the offset mechanism 101 in the following manner on the basis of information on an index value correlating with the basis weight of the recording material S onto which the toner image is transferred and on the basis of a detection result of the inner roller position sensor 251 (productivity priority mode). That is, when the relative position is the first relative position, in the case where the recording material S onto which the toner image is transferred is changed from the recording material S with the index value which is the first threshold or more to the recording material S with the index value which is less than the first threshold, the relative position is changed from the first relative position to the second relative position. Further, when the relative position is the second relative position, in the case where the recording material S onto which the toner image is transferred is changed from the recording material S with the index value which is less than the second threshold larger than the first threshold to the recording material S with the index value which is the second threshold or more, the relative position is changed from the second relative position to the first relative position. Further, in this embodiment, on the basis of the above-described information, the controller 300 is capable of executing the continuous image forming job in an operation in another mode for controlling the offset mechanism 101 in the following manner (normal mode). That is, in the case where the recording material S onto which the toner image is transferred is changed from the recording material S with the index value which is the first threshold or more to the recording material S with the index value which is less than the first threshold, the relative position is changed from the first relative position to the second relative position. Further, in the case where the recording material S onto which the toner image is transferred is changed from the recording material S with the index value which is less than the first threshold to the recording material S with the index value which is the first threshold or more, the relative position is changed from the second relative position to the first relative position.

In other words, in this embodiment, the controller 300 is capable of controlling the offset mechanism 101 in the following manner in the continuous image forming job. That is, the relative position is changed to the second relative position when the toner image is transferred onto a first recording material (for example, the "thin paper") with the index value falling within a first range. Further, the relative position is changed to the first relative position when the toner image is transferred onto a second recording material (for example, the "thick paper") with the index value falling within a second range larger than the first range. Further, when the toner image is transferred onto a third recording material (for example, the "plain paper") with the index value falling within a third range between the first range and the second range, the relative position is changed to the second relative position in the case where a preceding recording material on which the toner image is last transferred is the first recording material (for example, the "thin paper") and is changed to the first relative position in the case where the preceding recording material is the second recording material (for example, the "thick paper").

Incidentally, in this embodiment, at a time of a start of the job, the image forming apparatus 100 changes the offset amount X on the basis of the kind of the recording material S used in the printing. In order to reduce the frequency of the change in offset amount X, in this embodiment, the default (the home position of the inner roller 32) of the offset amount X is set at the first offset amount X1 (=1.0 mm). Further, the inner roller 32 is moved so that the offset amount X is the first offset amount X1 (=1.0 mm) at a time of an end of the job, and thereafter, the operation of the image forming apparatus 100 is stopped. That is, in this embodiment, in the case where the offset amount X is not the first offset amount X1 when the job is ended and the image forming apparatus 100 is in the stand-by state in which the image forming apparatus 100 stands by for a subsequent job, the inner roller 32 is moved so that the offset amount X is the first offset amount X1 (=1.0 mm). Also, when the image forming apparatus 100 is in the sleep state or the main switch thereof is turned off, the position of the inner roller 32 is maintained in a position where the offset amount X is the first offset amount X1. By this, if the toner image is subsequently printed on the "plain paper" or the "thick paper", which is frequently used as the recording material S in general, there is no need to perform the operation for changing the offset amount X at the time of the start of the job, and therefore, a time until the image formation is started is made short, so that the productivity can be improved. However, the present invention does not limit the home position of the inner roller 32 to the position where the offset amount X is the first offset amount X1, but the home position of the inner roller 32 may also be the position where the offset amount X is the second offset amount X2.

5. Control Mode

FIG. 7 is a schematic block diagram showing a control mode of a principal part of the image forming apparatus 100 of this embodiment. The controller (printer controller, control portion) 300 is constituted by the CPU 301 as a calculation control means, a ROM 302 and a RAM 303 which are storing means (storing portions), an input/output circuit for controlling input and output of signals between the controller 300 and devices connected to the controller 300, and the like. The controller 300 causes the CPU 301 to execute a process in accordance with a control program stored in the ROM 302 and carries out integrated control of various loads such as an image formation controller 230, a feeding controller 240, an operation display device controller 210, the inner roller driving motor 250, and the like. The RAM 303 is used as an operating area for temporarily holding (storing) control data and for a calculation process with the control. Further, to the controller 300, signals (output values) indicating detection results of the various sensors such as the inner roller position sensor 251 of the offset mechanism 101 are inputted. An output value of the inner roller position sensor 251 (relative position between the inner roller 32 and the outer roller 41 or information on the position of the secondary transfer nip N2) is stored in the RAM 303.

The image formation controller 230 controls the image forming system on the basis of the signal from the controller 300, so that the image forming operation for forming and outputting the image on the recording material S or the like operation is performed. This image forming system includes driving devices for driving the image forming portion 10 and the intermediary transfer belt 31 such as a drum driving motor and a belt driving motor, the exposure device 13, various voltage sources such as the charging voltage source, the developing voltage source, the primary voltage source and the secondary transfer voltage source, the fixing device 50, and the like. The feeding controller 240 controls, on the basis of the signal from the controller 300, a motor which is a driving source for driving members relating to feeding of the recording material S, such as the registration rollers 74 or the like motor, so that an operation for feeding the recording material S from the feeding device to the discharge tray. The operation display device controller 210 controls a user interface 90 (FIG. 1), so that transfer of information (signal) between the user interface 90 and the controller 300 is carried out.

The user interface 90 includes an operating portion constituted by a plurality of keys for setting various functions relating to the image formation and includes a display portion constituted by a display for displaying information indicating a setting state or the like. Further, the user interface 90 not only outputs, to the controller 300, key signals corresponding to operations of various keys of the operating portion, but also causes the display portion to display corresponding pieces of information on the basis of the signals from the controller 300. Further, to the controller 300, an external device 201 such as a personal computer may also be connected through an external interface (I/F) 202. Further, to the controller 150, an image reading apparatus (not shown) provided in or connected to the image forming apparatus 100 may also be connected.

The controller 300 causes the image forming apparatus 100 to form the image by controlling the respective portions of the image forming apparatus 100 on the basis of information on a job. The job information includes a start instruction (start signal) and information (instruction signal) on a printing operation condition such as a kind of the recording material S, which are inputted from the user interface 90 or the external device 201. Further, the job information includes image information (image signals) inputted from the external device 201 or the user interface 90. Incidentally, information on the kind of the recording material (this information is also simply referred to as "information on the recording material") encompasses arbitrary pieces of information capable of discriminating the recording material, inclusive of attributes (so-called paper kind categories) based on general features such as plain paper, quality paper, coated paper, embossed paper, thick paper and thin paper, numerals and numerical ranges such as a basis weight, a thickness, a size and rigidity, and brands (including manufacturers, product numbers and the like). In this embodiment, the information on the kind of the recording material S includes, as information on the kind of the recording material S relating to the rigidity of the recording material S, information on the basis weight of the recording material S. In the case where the information on the printing operation condition is inputted from the user interface 90, the user interface 90 functions as an inputting portion for inputting to the controller 300, the information on the index value correlating with the basis weight of the recording material S onto which the toner image is transferred. Further, in the case where the information on the printing operation condition is inputted from the external device 201 such as the personal computer, the external I/F 202 functions as the inputting portion for inputting, to the controller 300, the information on the index value correlating with the basis weight of the recording material S onto which the toner image is transferred.

Here, the image forming apparatus 100 executes a job (printing job, print job) which is a series of operations which is started by a single start instruction and in which the image is formed and outputted on a single recording material S or a plurality of recording materials S. The job includes an image forming step (printing operation, print operation, image forming operation), a pre-rotation step, a sheet (paper) interval step in the case where the images are formed on the plurality of recording materials S, and a post-rotation step in general. The image forming step is performed in a period in which formation of an electrostatic image for the image actually formed and outputted on the recording material S, formation of the toner image, primary transfer of the toner image and secondary transfer of the toner image are carried out. Specifically, timing during the image formation is different among positions where the respective steps of the formation of the electrostatic image, the toner image formation, the primary transfer of the toner image and the secondary transfer of the toner image are performed. The pre-rotation step is performed in a period of a preparatory operation, before the image forming step, from an input of the start instruction until the image is started to be actually formed. The sheet interval step is performed in a period corresponding to an interval between a recording material S and a subsequent recording material S when the images are continuously formed on a plurality of recording materials S (continuous image formation). The post-rotation step is performed in a period of a post-operation (preparatory operation) after the image forming step is performed. During non-image formation (non-image formation period) is a period other than the period of the image formation and includes the periods of the pre-rotation step, the sheet interval step, the post-rotation step and further includes a period of a pre-multi-rotation step, which is a preparatory operation during turning-on of a main switch (voltage source) of the image forming apparatus 100 or during restoration from a sleep state. Incidentally, the shape state (rest state) is, for example, a state in which supply of electric power to the respective portions, of the image forming apparatus 100, other than the controller 300 (or a part thereof) is stopped and electric power consumption is made smaller than electric power consumption in the stand-by state. In this embodiment, during the non-image formation, the offset mechanism 101 performs an operation of changing the offset amount X, i.e., an operation of changing the position of at least one of the inner roller 32 and the outer roller 41 (particularly the inner roller 32 in this embodiment).

6. Setting Method of Productivity Priority Mode

Part (a) of FIG. 8 is a schematic view showing the user interface 90 in this embodiment. The user interface 90 includes a start key 602 for starting the job, a stop key 603 for stopping the job, numeric keys 604 to 612 and 614 for making numeric setting, an ID key 613, a clear key 615, a reset key 616 and the like. Further, at a left-hand portion of the user interface 90, a display portion 620 constituted by a touch panel is provided, and on the display portion 620, software keys are capable of being formed. In this embodiment, the image forming apparatus 100 has a sheet setting function in which setting of the recording material S frequently used by a user is registered in advance as sheet brand information. Such setting is carried out by an input operation through the user interface 90. For example, when a "sheet setting" key which is software key on a display screen displayed at the display portion 620 as shown in part (a) of FIG. 8 is selected, a setting screen (menu selection screen) of the sheet brand information is displayed at the display portion 620 and sheet setting is carried out by using this screen.

The setting method of the "productivity priority mode" can be carried out in the following manner, for example. An operator such as the user or a service person presses down a "productivity priority" button which is a software key on an initial screen displayed at the display portion 620 as shown in part (a) of FIG. 8. When a signal indicating that the button was pressed down is inputted through the user interface 90, the CPU 301 of the controller 300 provides an instruction to the user interface 90 so that a "productivity priority mode setting screen" as shown in part (b) of FIG. 8 is displayed at the display portion 620. At this time, the CPU 301 provides an instruction to the user interface 90 so that setting information of a current "productivity priority mode" stored in the RAM 303 is displayed on the "productivity priority mode setting screen". In the case where the "productivity priority mode" is turned on (enabled), the operator presses down an "ON" button and then presses down an "OK" button. Further, in the case where the "productivity priority mode" is turned off (disabled), the operator presses down an "OFF" button and then presses down the "OK" button. Incidentally, in part (b) of FIG. 8, a state in which the "ON" button is pressed down and thus the "productivity priority mode" is turned on (enabled) is shown. When the CPU 301 detects that the setting of the "productivity priority mode" is changed by inputting, through the user interface 90, a signal indicating that the "ON" button or the "OFF" button and the "OK" button are pressed down, the CPU 301 causes the RAM 303 to store change contents thereof. Further, when the setting of the "productivity priority mode" is not changed from the current setting, the operator ends the display of the "productivity priority mode setting screen by pressing down a "CANCEL" button.

7-1. Changing Operation of Offset Amount

FIG. 9 is a flowchart showing an outline of a control procedure of a changing operation of the offset amount X in this embodiment. FIG. 9 shows the outline of the control procedure in the case where the image forming apparatus 100 executes the changing operation of the offset amount X during execution of a job. An outline of a control procedure of an operation of the job will be described later with reference to FIG. 10.

When the control procedure of FIG. 9 is started, in order to discriminate whether or not the changing operation of the offset amount X should be performed, the CPU 301 of the controller 300 acquires information on a threshold Th stored in the RAM 303 (S101). A determining method of this threshold Th will be described later in description of the control procedure of the operation of the job performed with reference to FIG. 10. Then, the CPU 301 acquires information on the basis weight of the recording material S stored in the RAM 303 (S102). Incidentally, the CPU 301 is capable of acquiring the information on the basis weight of the recording material S directly inputted (including selection from a plurality of choices) through the user interface 90 (or from the external device) by the operation of the operator. Further, the CPU 301 can also acquire the information on the kind of the recording material S on the basis of information, on recording material cassettes 61, 62 and 63 for feeding the recording materials S in the job, directly inputted from the user interface 90 (or the external device) through the operation by the operator. In this case, the CPU 301 is capable of acquiring the information on the kind of the recording material S from, for example, each of the plurality of recording material cassettes and associated information on the kind of the recording material S stored in the storing portion of the controller 300. Here, when the information on the kind of the recording material S is registered, the associated information may also be selected from a list of kinds of the recording materials S stored in advance in the storing portion of the controller 300 or in a storing device connected to the controller 300 through a network. Then, the CPU 301 discriminates whether or not the basis weight of the recording material S is less than the threshold Th (S103).

In the case where the CPU 301 discriminated in S103 that the basis weight of the recording material S is less than the threshold Th, the CPU 301 discriminates on the basis of an output value of the inner roller position sensor 251 stored in the RAM 303, whether or not the current offset amount X is the first offset amount X1 (=1.0 mm) (S104). In the case where the CPU 301 discriminated in S104 that the current offset amount X is the first offset amount X1 (=1.0 mm), the CPU 301 provides an instruction to the image formation controller 230 so that application of a high voltage for image formation is stopped in order to perform the changing operation of the offset amount X (S105). Then, when the application of the high voltage for image formation is completed in S105, the CPU 301 provides an instruction to drive the inner roller driving motor 250 and thus causes the inner roller 32 to move to a position where the offset amount X is the second offset amount X2 (=2.5 mm) (S106), and then ends the control procedure. Further, in the case where the CPU 301 discriminated in S104 that the current offset amount X is not the first offset amount X1 (=1.0 mm), i.e., is the second offset amount X2 (=2.5 mm), the CPU 301 does not perform the changing operation of the offset amount X, so that the control procedure is ended.

In the case where the CPU 301 discriminated in S103 that the basis weight of the recording material S is not less than the threshold Th, i.e., is the threshold Th or more, the CPU 301 discriminates on the basis of an output value of the inner roller position sensor 251 stored in the RAM 303, whether or not the current offset amount X is the second offset amount X2 (=2.5 mm) (S107). In the case where the CPU 301 discriminated in S107 that the current offset amount X is the second offset amount X2 (=2.5 mm), the CPU 301 provides an instruction to the image formation controller 230 so that application of a high voltage for image formation is stopped in order to perform the changing operation of the offset amount X (S108). Then, when the application of the high voltage for image formation is completed in S108, the CPU 301 provides an instruction to drive the inner roller driving motor 250 and thus causes the inner roller 32 to move to a position where the offset amount X is the first offset amount X1 (=1.0 mm) (S109), and then ends the control procedure. Further, in the case where the CPU 301 discriminated in S104 that the current offset amount X is not the second offset amount X2 (=2.5 mm), i.e., is the first offset amount X1 (=1.0 mm), the CPU 301 does not perform the changing operation of the offset amount X, so that the control procedure is ended.

Thus, in this embodiment, the CPU 301 of the controller 300 discriminates whether or not there is a need to change the offset amount X, depending on the basis weight of the recording material S and the current offset amount X (the position of the inner roller 32).

7-2. Operation of Job

FIG. 10 is a flowchart showing an outline of a control procedure of an operation of a job in this embodiment.

When the CPU 301 of the controller 300 acquires information on the job and starts the job, at first, the CPU 301 performs the changing operation of the offset amount X, in which the offset amount is changed depending on the basis weight of a first recording material S, at a time of a start of the job. That is, the CPU 301 acquires information on the basis weight of the first recording material S stored in the RAM 303 (S201). Incidentally, when the CPU 301 acquires the information of the job, the CPU 301 causes the RAM 303 to store information on a printing operation condition including the information on the basis weight of the recording material S. Then, the CPU 301 sets the threshold Th for discriminating whether or not the offset amount X changing operation should be performed, at the first threshold (=52 gsm) as an initial value, and then causes the RAM 303 to store the threshold Th (S202). Then, by using the set threshold Th, the CPU 301 controls the offset amount X changing operation described with reference to FIG. 9 (S203).

When the control of the offset amount X changing operation at the time of the start of the job is completed, the CPU 301 carries out control so as to perform the image forming operation on the recording material S. That is, in the case where the offset amount X changing operation is performed in the control of the offset amount X changing operation in S203, the application of the high voltage for image formation is stopped, so that the CPU 301 discriminates whether or not the application of the high voltage for image formation is stopped (S204). Then, in the case where the CPU 301 discriminated in S204 that the application of the high voltage for image formation is stopped, the CPU 301 provides an instruction to the image formation controller 230 so as to apply the high voltage for image formation (S205). Thereafter, the CPU 301 carries out control so that the image forming operation on the recording material S is performed at predetermined timing (S206). Further, in the case where the CPU 301 discriminated in S204 that the application of the high voltage for image formation is not stopped, the CPU 301 carries out control so that the image forming operation on the recording material S is performed at the predetermined timing (S206).

Next, when the image forming operation is completed, the CPU 301 discriminates whether or not there is a subsequent image formation requirement (S207). Then, in the case where the CPU 301 discriminated in S207 that the subsequent image formation requirement exists, the CPU 301 acquires information on the basis weight of a subsequent recording material S stored in the RAM 303 (S208). Thereafter, the CPU 301 acquires setting information on the "productivity priority mode" stored in the RAM 303, and then discriminates whether or not the "productivity priority mode" is enabled (S209). In the case where the CPU 301 discriminated in S209 that the "productivity priority mode" is enabled, the CPU 301 switches the threshold Th for discriminating whether or not the offset amount X changing operation should be performed, depending on the current offset amount. That is, the CPU 301 discriminates whether or not the current offset amount X is the second offset amount X2 (=2.5 mm) (S210). Then, in the case where the CPU 301 discriminated in S210 that the current offset amount X is the second offset amount X2 (=2.5 mm), the CPU 301 sets the threshold Th at the second threshold (=350 gsm) and then causes the RAM 303 to store the second threshold (S211). Further, in the case where the CPU 301 discriminated in S210 that the current offset amount X is not the second offset amount X2 (=2.5 mm), i.e., is the first offset amount X1 (=1.0 mm), the CPU 301 sets the threshold Th at the first threshold (=52 gsm) and then causes the RAM 303 to store the first threshold (S212). Then, by using the set threshold Th, the CPU 301 carries out control of the offset amount X changing operation described with reference to FIG. 9 (S203). Then, the CPU 301 repeats the processes from S204 to S212 until a subsequent image formation requirement is not made. Further, in the case where the CPU 301 discriminated in S209 that the "productivity priority mode" is not enabled, the CPU 301 sets the threshold Th at the first threshold (=52 gsm) and then causes the RAM 303 to store the first threshold (S212), so that control of the offset amount X changing operation is carried out (S203). Then, the CPU 301 repeats the processes from S204 to S212 until a subsequent image formation requirement is not made. Further, in the case where the CPU 301 discriminated in S210 that the current offset amount X is not the second offset amount X2 (=2.5 mm), the CPU 301 sets the threshold Th at the first threshold (=52 gsm) and then causes the RAM 303 to store the first threshold (S212), so that the CPU 301 carries out control of the offset amount X changing operation (S203). Then, the CPU 301 repeats the processes from S204 to S212 until a subsequent image formation requirement is not made.

In the case where the CPU 301 discriminated in S207 that there is no subsequent image formation requirement, the CPU 301 provides instruction to the image formation controller 230 so as to end the image forming operation (S213). When the image forming operation is ended, in order to return the offset amount X to the first offset amount X1 (=1.0 mm) which is the default (the home position of the inner roller 32), the CPU 301 discriminates whether or not the current offset amount X is the second offset amount X2 (=2.5 mm) (S214). Then, in the case where the CPU 301 discriminated in S214 that the current offset amount X is the second offset amount X2 (=2.5 mm), the CPU 301 provides an instruction to drive the inner roller motor 250 and causes the inner roller 32 to move to a position where the offset amount X is the first offset amount (=1.0 mm) (S215), and then ends the job. Further, in the case where the CPU 301 discriminated in S214 that the current offset amount X is not the second offset amount X2 (=2.5 mm), i.e., is the first offset amount X1 (=1.0 mm), the CPU 301 does not perform the offset amount X changing operation and then ends the job.

8. Effect

Next, an effect of this embodiment will be further described. When the "productivity priority mode" is enabled, a frequency of the change in offset amount X can be enabled in the case where the mixed job in which the images are printed on a plurality of recording materials S different in basis weight in a single job is executed. Parts (a) and (b) of FIG. 11 are time charts each schematically showing timing of the image forming operation in the case where images are printed on the "thin paper" (basis weight: 45 gsm) and the "plain paper" (basis weight: 80 gsm).

Part (a) of FIG. 11 shows the timing of the image forming operation in the case where the mixed job is executed in the operation in the "normal mode". The CPU 301 of the controller 300 carries out control so that the image forming operation on the "thin paper" is started at a time 0 and then is completed at a time to. Then, a subsequent recording material S is changed to the "plain paper" of 52 gsm or more in basis weight, and therefore, the CPU 301 carries out control so as to execute the offset amount X changing operation. At this time, the CPU 301 carries out control so as to start the offset amount X changing operation at timing (time t1) when the application of all the high voltages used for image formation is turned off, and later. Thereafter, the CPU 301 carries out control so that all the high voltages used for the image formation are applied again at timing (time t2) when the offset amount X changing operation is completed, and later. Then, at the timing of the completion of the offset amount X changing operation and later, the CPU 301 carries out control so as to perform the image forming operation on the "plain paper" (time t3). Then, when the image forming operation on the "plain paper" is ended, the CPU 301 carries out control so as to stop the operation of the image forming apparatus 100 (time t4).

Part (b) of FIG. 11 shows the timing of the image forming operation in the case where the mixed job is executed in the operation in the "productivity priority mode". The CPU 301 of the controller 300 carries out control so that the image forming operation on the "thin paper" is started at a time 0 and then is completed at a time t0. At this time, the current offset amount X is the second offset amount X2 (=2.5 mm), and a subsequent recording material S is the "plain paper" of less than 350 gsm in basis weight. For that reason, the CPU 301 discriminates that there is no need to perform the offset amount X changing operation and carries out control so as to start the image forming operation on the "plain paper" (time t5). Then, when the image forming operation on the "plain paper" is completed, the CPU 301 carries out control so as to stop the operation of the image forming apparatus 100 (time t6). Thus, in the operation in the "productivity priority mode", compared with the operation in the "normal mode", the frequency of the change in offset amount X can be reduced. As a result, in the operation in the "productivity priority mode", compared with the operation in the "normal mode", a time corresponding the operation of turning off of the application of the high voltages, the offset amount X changing operation and the operation of turning on of the application of the high voltages is not needed, so that it becomes possible to improve productivity corresponding to a difference (time T in part (b) of FIG. 11) between a time t4 and a time t6.

As described above, in this embodiment, the image forming apparatus 100 is capable of executing the mixed job for printing the images on the plurality of recording materials S different in basis weight in the operation in the "productivity priority mode". In the operation in the "productivity priority mode", depending on the current offset amount X (the inner roller 32), the threshold (discrimination condition) for discriminating whether or not the offset amount X changing operation should be performed is switched. By this, during execution of the mixed job, in the "productivity priority mode", compared with the "normal mode", the frequency of the change in offset amount X (position of the inner roller 32) can be reduced. As a result, in the "productivity priority mode", compared with the "normal mode", the productivity can be improved. Accordingly, according to this embodiment, it is possible to suppress a lowering in productivity while realizing improvement of a transfer property of the images onto the recording material S in the mixed job.

Incidentally, in this embodiment, the constitution in which the image forming apparatus 100 is capable of arbitrarily selecting and executing the operation in the "normal mode" and the operation in the "productivity priority mode" was employed. On the other hand, a constitution in which the priority is given to the productivity in the image forming apparatus 100 and in which the image forming apparatus 100 is capable of executing the continuous image forming job only in an operation mode corresponding to the operation in the "productivity priority mode" of the "normal mode" and the "productivity priority mode" in this embodiment can also be employed.

Embodiment 2

Next, another embodiment of the present invention will be described. Basic constitutions and operations of an image forming apparatus in this embodiment are the same as those of the image forming apparatus in the embodiment 1. Accordingly, elements having the same or corresponding functions or constitutions as those in the embodiment 1 are represented by the same reference numerals or symbols as those in the embodiment 1 and will be omitted from detailed description.

1. Outline of this Embodiment

In this embodiment, a constitution in which a job is capable of being executed in an operation in a "thin paper priority mode" in which productivity is improved for users who principally use the "thin paper" and the "plain paper", for example, is employed. That is, the "thin paper priority mode" as a second mode is a mode such that in the case where a use frequency of the "thin paper" or the "plain paper" is higher than a use frequency of the "thick paper", the frequency of the change in offset amount X in this (second) mode can be made lower than the frequency of the change in offset amount X in the "normal mode" as the first mode.

Part (a) of FIG. 12 is a schematic view showing a changing condition of the offset amount X in the operation in the "normal mode", and is the same as the changing condition of the offset amount X shown in part (a) of FIG. 6. In the operation in the "normal mode", as the threshold for discriminating whether or not the changing operation of the offset amount X should be performed, the first threshold (=52 gsm) is used.

Part (b) of FIG. 12 is a schematic view showing a changing condition of the offset amount X in the operation in the "thin paper priority mode". In the operation in the "thin paper priority mode", it is considered that the use frequency of the "thick paper" is low, so that as the threshold for discriminating whether or not the offset amount X changing operation should be performed, the second threshold (=350 gsm) larger than the first threshold (=52 gsm) is used. By this, for the users who preferentially use the "thin paper" or the "plain paper", compared with the "normal mode", it is possible to reduce the frequency of the change in offset amount X.

2. Setting Method of Thin Paper Priority Mode

Part (a) of FIG. 13 is a schematic view showing a user interface 90 in this embodiment.

The setting method of the "thin paper priority mode" can be carried out in the following manner, for example. An operator such as the user or a service person presses down a "thin paper priority" button which is a software key on an initial screen displayed at the display portion 620 as shown in part (a) of FIG. 13. When a signal indicating that the button was pressed down is inputted through the user interface 90, the CPU 301 of the controller 300 provides an instruction to the user interface 90 so that a "thin paper priority mode setting screen" as shown in part (b) of FIG. 13 is displayed at the display portion 620. At this time, the CPU 301 provides an instruction to the user interface 90 so that setting information of a current "thin paper priority mode" stored in the RAM 303 is displayed on the "thin paper priority mode setting screen". In the case where the "thin paper priority mode" is turned on (enabled), the operator presses down an "ON" button and then presses down an "OK" button. Further, in the case where the "thin paper priority mode" is turned off (disabled), the operator presses down an "OFF" button and then presses down the "OK" button. Incidentally, in part (b) of FIG. 13, a state in which the "ON" button is pressed down and thus the "thin paper priority mode" is turned on (enabled) is shown. When the CPU 301 detects that the setting of the "thin paper priority mode" is changed by inputting, through the user interface 90, a signal indicating that the "ON" button or the "OFF" button and the "OK" button are pressed down, the CPU 301 causes the RAM 303 to store change contents thereof. Further, when the setting of the "thin paper priority mode" is not changed from the current setting, the operator ends the display of the "thin paper priority mode" setting screen by pressing down a "CANCEL" button.

3. Operation of Job

FIG. 14 is a flowchart showing an outline of a control procedure of an operation of a job in this embodiment.

When the CPU 301 of the controller 300 acquires information on the job and starts the job, at first, the CPU 301 acquires the basis weight of a first recording material S stored in the RAM 303 (S301). Then, the CPU 301 acquires setting information on the "thin paper priority mode" stored in the RAM 303 and discriminates whether or not the "thin paper priority mode" is enabled (S302). Then, in the case where the CPU 301 discriminated in S302 that the "thin paper priority mode" is enabled, the CPU 301 sets the threshold Th for discriminating whether or not the offset amount X changing operation should be performed, at the second threshold (=350 gsm), and then causes the RAM 303 to store the second threshold (S303). Further, in the case where the CPU 301 discriminated in S302 that the "thin paper priority mode" is not enabled, the CPU 301 sets the threshold Th at the first threshold Th (=52 gsm) and then causes the RAM 303 to store the first threshold (S304). Thereafter, by using the set threshold Th, the CPU 301 controls the offset amount X changing operation described in the embodiment 1 with reference to FIG. 9 (S305). In the case where the offset amount X changing operation is performed in the control of the offset amount X changing operation in S305, the application of the high voltage for image formation is stopped, so that the CPU 301 discriminates whether or not the application of the high voltage for image formation is stopped (S306). Then, in the case where the CPU 301 discriminated in S306 that the application of the high voltage for image formation is stopped, the CPU 301 provides an instruction to the image formation controller 230 so as to apply the high voltage for image formation (S307). Thereafter, the CPU 301 carries out control so that the image forming operation on the recording material S is performed at predetermined timing (S308). Further, in the case where the CPU 301 discriminated in S306 that the application of the high voltage for image formation is not stopped, the CPU 301 carries out control so that the image forming operation on the recording material S is performed at the predetermined timing (S308).

Next, when the image forming operation is completed, the CPU 301 discriminates whether or not there is a subsequent image formation requirement (S309). Then, in the case where the CPU 301 discriminated in S309 that the subsequent image formation requirement exists, the CPU 301 acquires information on the basis weight of a subsequent recording material S stored in the RAM 303 (S310). Thereafter, the CPU 301 carries out control so as to perform the image forming operation on the recording material S by executing the processes from S305 to S308 again (S308). Then, the CPU 301 repeats the processes from S305 to S310 until a subsequent image formation requirement is not made.

In the case where the CPU 301 discriminated in S309 that there is no subsequent image formation requirement, the CPU 301 provides instruction to the image formation controller 230 so as to end the image forming operation (S311). When the image forming operation is ended, the CPU 301 acquires the setting information of the "thin paper priority mode" stored in the RAM 303 and then discriminated whether or not the "thin paper priority mode" is enabled (S312). Then, in the case where the CPU 301 discriminated in S312 that the "thin paper priority mode" is enabled, the CPU 301 discriminates whether or not the current offset amount X is the first offset amount X1 (=1.0 mm) (S313). Then, in the case where the CPU discriminated in S313 that the current offset amount X is the first offset amount X1 (=1.0 mm), the CPU 301 provides an instruction to the inner roller driving motor 250 so as to drive and thus causes the inner roller driving motor 250 to move the inner roller 32 to a position where the offset amount X is the second offset amount X2 (=2.5 mm) (S314), and then ends the job. Further, in the case where the CPU 301 discriminated in S313 that the current offset amount X is not the first offset amount X1 (=1.0 mm), the CPU 301 does not perform the offset amount X changing operation and then ends the job. Further, in the case where the CPU 301 discriminated in S312 that the "thin paper priority mode" is not enabled, the CPU 301 discriminates whether or not the current offset amount X is the second offset amount X2 (=25 mm) (S315). Then, in the case where the CPU 301 discriminated in S315 that the current offset amount X is the second offset amount X2 (=2.5 mm), the CPU 301 provides an instruction to drive the inner roller motor 250 and causes the inner roller 32 to move to a position where the offset amount X is the first offset amount (=1.0 mm) (S316), and then ends the job. Further, in the case where the CPU 301 discriminated in S315 that the current offset amount X is not the second offset amount X2 (=2.5 mm), the CPU 301 does not perform the offset amount X changing operation and then ends the job.

4. Effect

As described above, in this embodiment, the image forming apparatus 100 is capable of executing the mixed job for printing the images on the plurality of recording materials S different in basis weight in the operation in the "thin paper priority mode". In the operation in the "thin paper priority mode", as the threshold (discrimination condition) for discriminating whether or not the changing operation of the offset amount X should be performed, the second threshold different from the first threshold used in the operation in the "normal mode" is used. That is, in the operation in the "productivity priority mode", the threshold (discrimination condition) for discriminating whether or not the offset amount X changing operation should be performed is always made larger than the threshold in the operation in the "normal mode". By this, in the case where a use frequency of the "thin paper" or the "plain paper" is higher than a use frequency of the "thick paper", compared with the "normal mode", the frequency of the change in offset amount X (position of the inner roller 32) can be reduced. As a result, in the case where the use frequency of the "thin paper" or the "plain paper" is higher than the use frequency of the "thick paper", in the "thin paper priority mode", compared with the "normal mode", the productivity can be improved. Accordingly, according to this embodiment, it is possible to suppress a lowering in productivity while realizing improvement of a transfer property of the images onto the recording material S in the mixed job.

Further, in this embodiment, as shown in FIG. 14, in the case where the "thin paper priority mode" is enabled, at the time of the end of the job, the offset amount X is changed to the second offset amount X2 (=2.5 mm) corresponding to the "thin paper" (or the "plain paper"). By this, for the users who frequently use the "thin paper" or the "plain paper", the frequency of the change in offset amount X (the position of the inner roller 32) at the time of the start of the job is reduced, so that FCOT (first copy time) can be reduced. Here, the FCOT is a time from input of the job start instruction until the first recording material S on which the image is formed is outputted.

Incidentally, in this embodiment, the "thin paper priority mode" was described on the basis of the "normal mode", but it is also possible to consider the "thin paper priority mode" as a base mode (i.e., regards the "thin paper priority mode" as the "normal mode"). In this case, it is possible to consider a mode corresponding to the "normal mode" in this embodiment as the "thick paper priority mode".

Further, in this embodiment, the operation in the "thin paper priority mode" was described, but in the case where the "thin paper priority mode" is disabled, the operation in the "productivity priority mode" described in the first embodiment may also be performed. By this, it becomes possible to provide a productivity enhancing means for users who are not the users who preferentially use the "thin paper" or the "plain paper".

Embodiment 3

Next, another embodiment of the present invention will be described. Basic constitutions and operations of an image forming apparatus in this embodiment are the same as those of the image forming apparatus in the embodiment 1. Accordingly, elements having the same or corresponding functions or constitutions as those in the embodiment 1 are represented by the same reference numerals or symbols as those in the embodiment 1 and will be omitted from detailed description.

1. Outline of this Embodiment

In this embodiment, another form of the "thin paper priority mode" will be described. In this embodiment, an image forming apparatus 100 is constituted so as to be capable of executing a job in an operation in a "thin paper priority mode" in which the offset amount X during image formation is always the second offset amount X2 (=2.5 mm). In the operation in the "thin paper priority mode", it is possible to suppress the improper separation of the "thin paper" from the intermediary transfer belt. Further, in the operation in the "thin paper priority mode", for users who principally use the "thin paper" or the "plain paper" and who permit the trailing end portion image defect which can occur on the "thick paper", it becomes possible to suppress a lowering in productivity due to the change in offset amount X. Also, in the operation in the "thin paper priority mode" in this embodiment, the improper separation of the "thin paper" from the intermediary transfer belt can be suppressed.

2. Control Procedure

FIG. 15 is a flowchart showing an outline of a control procedure of an operation of a job in this embodiment.

When the CPU 301 of the controller 300 acquires information on the job and starts the job, at first, the CPU 301 acquires the basis weight of a first recording material S stored in the RAM 303 (S401). Then, the CPU 301 acquires setting information on the "thin paper priority mode" stored in the RAM 303 and discriminates whether or not the "thin paper priority mode" is enabled (S402). In this embodiment, as described later, in the case where the "thin paper priority mode" is enabled, at the time of the start of the job, the offset amount X is the second offset amount X2 (=2.5 mm) corresponding to the "thin paper" (or the "plain paper"). For that reason, in this case, the offset amount X changing operation is not needed. That is, in the case where the CPU 301 discriminated in S402 that the "thin paper priority mode" is enabled, the CPU 301 does not perform the offset amount X changing operation and discriminates whether or not the application of the high voltage for image formation is stopped (S405). Further, in the case where the CPU 301 discriminated in S402 that the "thin paper priority mode" is not enabled, the CPU 301 sets the threshold Th for discriminating whether or not the offset amount X changing operation should be performed, at the predetermined threshold (=52 gsm), and then causes the RAM 303 to store the second threshold (S403). Thereafter, by using the set threshold Th, the CPU 301 controls the offset amount X changing operation described in the embodiment 1 with reference to FIG. 9 (S404). In the case where the offset amount X changing operation is performed in the control of the offset amount X changing operation in S404, the application of the high voltage for image formation is stopped, so that the CPU 301 discriminates whether or not the application of the high voltage for image formation is stopped (S405).

In the case where the CPU 301 discriminated in S405 that the application of the high voltage for image formation is stopped, the CPU 301 provides an instruction to the image formation controller 230 so as to apply the high voltage for image formation (S406). Thereafter, the CPU 301 carries out control so that the image forming operation on the recording material S is performed at predetermined timing (S407). Further, in the case where the CPU 301 discriminated in S405 that the application of the high voltage for image formation is not stopped, the CPU 301 carries out control so that the image forming operation on the recording material S is performed at the predetermined timing (S407).

Next, when the image forming operation is completed, the CPU 301 discriminates whether or not there is a subsequent image formation requirement (S408). Then, in the case where the CPU 301 discriminated in S408 that the subsequent image formation requirement exists, the CPU 301 acquires information on the basis weight of a subsequent recording material S stored in the RAM 303 (S409). Thereafter, the CPU 301 carries out control so as to perform the image forming operation on the recording material S by executing the processes from S402 to S407 again (S407). Then, the CPU 301 repeats the processes from S402 to S409 until a subsequent image formation requirement is not made.

In the case where the CPU 301 discriminated in S408 that there is no subsequent image formation requirement, the CPU 301 provides instruction to the image formation controller 230 so as to end the image forming operation (S410). When the image forming operation is ended, the CPU 301 acquires the setting information of the "thin paper priority mode" stored in the RAM 303 and then discriminated whether or not the "thin paper priority mode" is enabled (S411). Then, in the case where the CPU 301 discriminated in S411 that the "thin paper priority mode" is enabled, the CPU 301 discriminates whether or not the current offset amount X is the first offset amount X1 (=1.0 mm) (S412). Then, in the case where the CPU discriminated in S412 that the current offset amount X is the first offset amount X1 (=1.0 mm), the CPU 301 provides an instruction to the inner roller driving motor 250 so as to drive and thus causes the inner roller driving motor 250 to move the inner roller 32 to a position where the offset amount X is the second offset amount X2 (=2.5 mm) (S413), and then ends the job. Further, in the case where the CPU 301 discriminated in S412 that the current offset amount X is not the first offset amount X1 (=1.0 mm), the CPU 301 does not perform the offset amount X changing operation and then ends the job. Further, in the case where the CPU 301 discriminated in S411 that the "thin paper priority mode" is not enabled, the CPU 301 discriminates whether or not the current offset amount X is the second offset amount X2 (=25 mm) (S414). Then, in the case where the CPU 301 discriminated in S414 that the current offset amount X is the second offset amount X2 (=2.5 mm), the CPU 301 provides an instruction to drive the inner roller motor 250 and causes the inner roller 32 to move to a position where the offset amount X is the first offset amount (=1.0 mm) (S415), and then ends the job. Further, in the case where the CPU 301 discriminated in S414 that the current offset amount X is not the second offset amount X2 (=2.5 mm), the CPU 301 does not perform the offset amount X changing operation and then ends the job.

4. Effect

As described above, in this embodiment, the image forming apparatus 100 is capable of executing the mixed job for printing the images on the plurality of recording materials S different in basis weight in the operation in the "thin paper priority mode". In the operation in the "productivity priority mode", the offset amount X is fixed at the second offset amount X2 (=2.5 mm) corresponding to the "thin paper" or the "plain paper". By this, in the case where a use frequency of the "thin paper" or the "plain paper" is higher than a use frequency of the "thick paper" or in the like case, when the trailing end portion image defect which can occur on the "thick paper" can be allowed, it becomes possible to suppress a lowering of productivity due to the change in offset amount X (the position of the inner roller 32). Accordingly, according to this embodiment, it is possible to suppress a lowering in productivity while realizing improvement of a transfer property of the images onto the recording material S in the mixed job.

Further, in this embodiment, similarly as in the second embodiment, in the case where the "thin paper priority mode" is enabled, at the time of the end of the job, the offset amount X is changed to the second offset amount X2 (=2.5 mm) corresponding to the "thin paper" (or the "plain paper"). By this, similarly as in the embodiment 2, the FCOT can be reduced.

Further, in this embodiment, the operation in the "thin paper priority mode" was described, but in the case where the "thin paper priority mode" is disabled, the operation in the "productivity priority mode" described in the first embodiment may also be performed. By this, it becomes possible to provide a productivity enhancing means for users who are not the users who preferentially use the "thin paper" or the "plain paper". Further, the "thin paper priority mode" described in the embodiment 2 and in this embodiment may also be capable of being selected and executed.

Other Embodiments

The present invention was described above based on specific embodiments, but is not limited thereto.

The offset amount and the kind (basis weight) of the recording material assigned to the associated offset amount are not limited to the above-described specific examples described in the above-described embodiment. These can appropriately be set through an experiment or the like from viewpoints of improvement in separating property of the recording material from the intermediary transfer belt and suppression of the image defect at the trailing end portion of the recording material with respect to the recording material feeding direction, which are described above. The offset amount is not limited thereto, but may suitably be about −3 mm to about +3 mm. By such setting, a good transfer property can be obtained. Further, the pattern of the offset amount is not limited to the two patterns, but three or more patterns may also be set. In this case, for example, in order to reduce the frequency of the change in offset amount between the two patterns with large basis weights, it is possible to provide the "productivity priority mode" in which the threshold is used in the switching manner similarly as in the embodiment 1.

In the above-described embodiments, the constitution in which the offset amount is changed by changing the position of the inner roller is employed, but a constitution in which the offset amount J changed by changing the position of the outer roller may also be employed. Further, the present invention is not limited to a constitution in which either one of the inner roller and the outer roller is moved but may also employ a constitution in which the offset amount is changed by moving both the inner roller and the outer roller.

In the above-described embodiments, as an outer member for forming the secondary transfer nip in cooperation with the inner roller as an inner member, the outer roller directly contacting the outer peripheral surface of the intermediary transfer belt was used. On the other hand, a constitution in which as the outer member, the outer roller and a secondary transfer belt stretched by the outer roller and other rollers are used may also be employed. That is, the image forming apparatus may include, as the outer member, the stretching rollers, the outer roller and the secondary transfer belt stretched between these rollers. Further, the secondary transfer roller is contacted to the outer peripheral surface of the intermediary transfer belt by the outer roller. In such a constitution, by the inner roller contacting the inner peripheral surface of the intermediary transfer belt and the outer roller contacting the inner peripheral surface of the secondary transfer belt, the intermediary transfer belt and the secondary transfer belt are sandwiched, so that the secondary transfer nip is formed. In this case, a contact portion between the intermediary transfer belt and the secondary transfer belt is the secondary transfer nip as the secondary transfer portion. Incidentally, also in this case, the offset amount X is defined by the relative position between the inner roller and the outer roller similarly as described above.

In the above-described embodiments, the information on the kind of the recording material relating to the rigidity of the recording material is not limited to information on the basis weight itself of the recording material, but an index value correlating with the basis weight can be used. In the case where a paper kind category (for example, plain paper and coated paper which are the paper kind categories based on a surface property) or a brand (including a manufacturer, a product number or the like) is the same, the basis weight of the recording material and the thickness of the recording material are in a substantially proportional relationship in many instances (in which the basis weight is larger with an increasing thickness). Further, in the case where the paper kind category or the brand is the same, the basis weight or the thickness of the recording material are in a substantially proportional relationship in many instances (in which the rigidity is larger with an increasing basis weight or thickness). Accordingly, for example, the control can be carried out on the basis of the index value (basis weight, thickness, rigidity or the like) correlating with the basis weight of the recording material for each of the paper kind categories, the brands or combinations of the paper kind category and the brand. Incidentally, the rigidity of the recording material can be represented by Gurley rigidity (stiffness) (MD/long fold) [mN] and can be measured by a commercially available Gurley stiffness tester. For example, the Gurley stiffness (MD) which is an example of the rigidity of the "thin paper" as the recording material of less than 52 gsm (g/m$^2$), which is the threshold of the basis weight in the above-described embodiments, is about 0.3 mN in some instances. Further, the Gurley stiffness (MD) which is the example of the rigidity of the "plain paper" (basis weight: about 80 g/m$^2$) as the recording material of not less than 52 gsm (g/m$^2$), which is the threshold of the basis weight in the above-described embodiments is about 2 mN, and the Gurley stiffness (MD) which is the example of the rigidity of the "thick paper" (basis weight: about 200 g/m$^2$) is about 20 mN in some instances.

In the above-described embodiments, description of the controller included the controller acquiring the information on the kind of the recording material on the basis of the input thereof from the operating portion or the external device through the operation by the operator, but the controller may also acquire the information on the kind of the recording material on the basis of the input of a detection result of the detecting means. For example, a basis weight sensor can be used as a basis weight detecting means for detecting an index value correlating with the basis weight of the recording material. As the basis weight sensor, for example, a basis weight sensor utilizing attenuation of ultrasonic wave has been known. This basis weight sensor includes an ultrasonic generating portion and an ultrasonic receiving portion which are provided so as to sandwich a recording material feeding passage. The basis weight sensor generates the ultrasonic wave from the ultrasonic generating portion and receives the ultrasonic wave attenuation by being passed through the recording material, and then on the basis of attenuation amount of the ultrasonic wave, detects the index value correlating with the basis weight of the recording material. Incidentally, the basis weight detecting means may only be required to be capable of detecting the index value correlating with the basis weight of the recording material and is not limited to the basis weight detecting means utilizing the ultrasonic wave, but may also be a basis weight detecting means utilizing light, for example. The index value correlating with the basis weight of the recording material is not limited to the basis weight itself, but may also be a thickness corresponding to the basis weight. Further, a surface property sensor can be used as a smoothness detecting means for detecting an index value correlating with surface smoothness of the recording material capable of being utilized for detecting the paper kind category. As the surface property sensor, a regularly/irregularly reflected light sensor for reading intensity of regularly reflected light and irregularly reflected light by irradiating the recording material with light has been known. In the case where the surface of the recording material is smooth, the regularly reflected light becomes strong, and in the case where the surface of the recording material is rough, the irregularly reflected light becomes strong. For that reason, the surface property sensor is capable of detecting the index value corresponding with the smoothness of the recording material surface by measuring a regularly reflected light quantity and an irregularly reflected light quantity. Incidentally, the smoothness detecting means may only be required to be capable of detecting the index value correlating with the smoothness of the recording material surface and is not limited to the above-described smoothness detecting means using the light quantity sensor, but may also be a smoothness detecting means using, for example, an image-pick up element. The index correlating the smoothness of the recording material surface is not limited to a value converted to a value in conformity to a predetermined standard such as Bekk smoothness, but may only be required to be a value having a correlation with the smoothness of the recording material surface. These detecting means can be disposed adjacent to the recording material feeding passage on a side upstream of the recording material rollers with respect to the recording material feeding direction, for example. Further, for example, a detecting means (media sensor) constituted as a single unit including the above-described basis weight sensor, the surface property sensor, and the like may be used.

In the above-described embodiments, as the offset mechanism and the contact-and-separation mechanism, an actuator for actuating the movable portion by the cam was used, but the offset mechanism is not limited thereto. Each of the offset mechanism and the contact-and-separation mechanism may only be required to be capable of realizing an operation in conformity with each of the above-described embodiments, and for example, an actuator for actuating the movable portion by using a solenoid may be used, for example.

Further, in the above-described embodiments, the case where the belt-shaped image bearing member was the intermediary transfer belt was described, but the present invention is applicable when an image bearing member constituted by an endless belt for feeding the toner image borne at the image forming position is used. Examples of such a belt-shaped image bearing member may include a photosensitive (member) belt and an electrostatic recording dielectric (member) belt, in addition to the intermediary transfer belt in the above-described embodiments.

Further, the present invention can be carried out also in other embodiments in which a part or all of the constitutions of the above-described embodiments are replaced with alternative constitutions thereof. Accordingly, when the image forming apparatus using the belt-shaped image bearing member is used, the present invention can be carried out with no distinction as to tandem type/single drum type, a charging type, an electrostatic image forming type, a developing type, a transfer type and a fixing type. In the above-described embodiments, a principal part relating to the toner image formation/transfer was described principally, but the present invention can be carried out in various uses, such as printers, various printing machines, copying machines, facsimile machines and multi-function machines, by adding necessary device, equipment and a casing structure.

According to the present invention, it is possible to suppress the lowering in productivity while improving the transfer property of the recording material in the mixed job.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-031082 filed on Feb. 26, 2020, which is hereby incorporated by reference herein in its entirety.

What is claimed is:

1. An image forming apparatus comprising:

an image forming portion configured to form toner images;

a rotatable intermediary transfer belt onto which the toner images formed by said image forming portion are transferred;

a plurality of stretching rollers stretching said intermediary transfer belt and including an inner roller and an upstream roller provided adjacent to said inner roller on a side upstream of said inner roller with respect to a rotational direction of said intermediary transfer belt;

an outer roller contacting an outer peripheral surface of said intermediary transfer belt and configured to form a transfer nip, where the toner images are transferred from said intermediary transfer belt onto a recording material, by nipping said intermediary transfer belt between said outer roller and said inner roller;

a moving mechanism capable of moving a position of said inner roller between a first position where an offset amount X is a first offset amount X1 and a second position where the offset amount X is a second offset amount X2, which is greater than the first offset amount X1, wherein in a cross-section perpendicular to a rotational axis direction of said inner roller, an external common tangential line between said inner roller and said upstream roller on a side where said intermediary transfer belt is stretched by these rollers is a reference line L1, a rectilinear line passing through a rotation center of said inner roller and perpendicular to the reference line L1 is an inner roller center line L2, a rectilinear line passing through a rotation center of said outer roller and perpendicular to the reference line L1 is an outer roller center line L3, and a distance between the inner roller center line L2 and the outer roller center line L3 is the offset amount X, which is a positive value when the outer roller center line L3 is positioned upstream of the inner roller center line L2 with respect to the rotational direction of said intermediary transfer belt; and a controller configured to control said moving mechanism, wherein said controller is capable of executing an operation in a first mode and an operation in a second mode, in which a continuous image forming job for transferring toner images onto a plurality of recording materials including a first recording material and a second recording material subsequent to the first recording material is executed, wherein in the first mode, when the toner images are transferred onto the first recording material having a first basis weight, the position of said inner roller is the first position, and when the toner images are transferred onto the second recording material having a second basis weight less than the first basis weight, the position of said inner roller is the first position, and wherein in the second mode, when the toner images are transferred onto the first recording material having the first basis weight, the position of said inner roller is the first position, and when the toner images are transferred onto the second recording material having the second basis weight less than the first basis weight, the position of said inner roller is the second position.

2. The image forming apparatus according to claim 1, wherein in the first mode, when the toner images are transferred onto the second recording material having a third basis weight less than the second basis weight, the position of said inner roller is the second position.

3. The image forming apparatus according to claim 1, wherein in the first mode, when the toner images are transferred onto the first recording material having a third basis weight less than the second basis weight, the position of said inner roller is the second position.

4. The image forming apparatus according to claim 1, wherein said controller controls said moving mechanism on the basis of information on the recording material.

5. An image forming apparatus comprising:

an image forming portion configured to form toner images;

a rotatable intermediary transfer belt onto which the toner images formed by said image forming portion are transferred;

a plurality of stretching rollers stretching said intermediary transfer belt and including an inner roller and an upstream roller provided adjacent to said inner roller on a side upstream of said inner roller with respect to a rotational direction of said intermediary transfer belt;

an outer roller contacting an outer peripheral surface of said intermediary transfer belt and configured to form a transfer nip, where the toner images are transferred from said intermediary transfer belt onto a recording material, by nipping said intermediary transfer belt between said outer roller and said inner roller;

a moving mechanism capable of moving a position of said inner roller between a first position where an offset amount X is a first offset amount X1 and a second position where the offset amount X is a second offset amount X2, which is greater than the first offset amount X1, wherein in a cross-section perpendicular to a rotational axis direction of said inner roller, an external common tangential line between said inner roller and said upstream roller on a side where said intermediary transfer belt is stretched by these rollers is a reference line L1, a rectilinear line passing through a rotation center of said inner roller and perpendicular to the reference line L1 is an inner roller center line L2, a rectilinear line passing through a rotation center of said outer roller and perpendicular to the reference line L1 is an outer roller center line L3, and a distance between the inner roller center line L2 and the outer roller center line L3 is the offset amount X, which is a positive value when the outer roller center line L3 is positioned upstream of the inner roller center line L2 with respect to the rotational direction of said intermediary transfer belt; and a controller configured to control said moving mechanism, wherein said controller is capable of executing an operation in a first mode and an operation in a second mode, in which a continuous image forming job for transferring toner images onto a plurality of recording materials including a first recording material and a second recording material subsequent to the first recording material is executed, wherein in the first mode, when the toner images are transferred onto the first recording material having a second basis weight, the position of said inner roller is the second position, and when the toner images are transferred onto the second recording material having a first basis weight greater than the second basis weight, the position of said inner roller is the second position, and wherein in the second mode, when the toner images are transferred onto the first recording material having the second basis weight, the position of said inner roller is the second position, and when the toner images are transferred onto the second recording material having the first basis weight greater than the second basis weight, the position of said inner roller is the first position.

6. The image forming apparatus according to claim 5, wherein in the first mode, when the toner images are transferred onto the second recording material having a third basis weight greater than the first basis weight, the position of said inner roller is the first position.

7. The image forming apparatus according to claim 5, wherein in the first mode, when the toner images are transferred onto the first recording material having a third basis weight greater than the first basis weight, the position of said inner roller is the first position.

8. The image forming apparatus according to claim 5, wherein said controller controls said moving mechanism on the basis of information on the recording material.

* * * * *